US006349489B1

(12) United States Patent
Sasaki et al.

(10) Patent No.: US 6,349,489 B1
(45) Date of Patent: Feb. 26, 2002

(54) STRUCTURE FOR WORKING UNIT FOR BUCKET EXCAVATORS AND METHOD FOR MANUFACTURING THE SAME

(75) Inventors: Hidetoshi Sasaki, Kawasaki; Toshio Tanaka, Hirakata; Tatsushi Itoh, Hirakata; Nobuyoshi Masumoto, Hirakata, all of (JP)

(73) Assignee: Komatsu Ltd. (JP)

( * ) Notice: Subject to any disclaimer, the term of this patent is extended or adjusted under 35 U.S.C. 154(b) by 0 days.

(21) Appl. No.: 09/484,637

(22) Filed: Jan. 18, 2000

Related U.S. Application Data

(63) Continuation of application No. PCT/JP98/03182, filed on Jul. 15, 1998.

(30) Foreign Application Priority Data

Jul. 15, 1997 (JP) ..... 9-189502

(51) Int. Cl.[7] ..... E02B 15/06
(52) U.S. Cl. ..... 37/443
(58) Field of Search ..... 37/443, 444, 417, 37/411, 903, 264

(56) References Cited

U.S. PATENT DOCUMENTS 3,708,937 A * 1/1973 Sterner ..... 52/118
4,712,697 A * 12/1987 McGowan ..... 212/189
4,977,674 A * 12/1990 van der Merwe et al. . 30/379.5
5,152,636 A * 10/1992 Myers ..... 405/68
6,085,993 A * 7/2000 Beggs ..... 239/166

* cited by examiner

*Primary Examiner*—Christopher J. Novosad
(74) *Attorney, Agent, or Firm*—Morrison Law Firm

(57) ABSTRACT

An arm body of a working machine has a hollow and triangular cross-section. A bucket-connection bracket is jointed to one longitudinal end of an arm body, and an arm cylinder bracket is jointed to another longitudinal end of the arm body, thereby forming an arm. With the triangular cross-sectional structure, the arm body is less prone to deformation under the stress of a load. The improved triangular cross-sectional structure permits the plate thickness of the arm body to be reduced, and the rigidity of the arm body to be increased without mounting a cross-section restraint material in the arm body. The cross-section of the boom will not deform even though the plate thickness is reduced. Therefore, it is possible to reduce the weight of the boom and still prevent deformation of the boom under heavy load. A method of producing an arm body is efficient and simplified since a single sheet of metal may be formed into a triangular shape, with a single welded seem being formed at the seem between abutting edges of the metal material. The various corners of the triangular cross-section may be arc shaped or flat as is desired.

10 Claims, 24 Drawing Sheets

STRUCTURE FOR WORKING UNIT FOR BUCKET EXCAVATORS AND METHOD FOR MANUFACTURING THE SAME

This application is a continuation of PCT/JP98/03182 filed Jul. 15, 1998, published as WO 99/04104 on Jan. 28, 1999.

BACKGROUND OF THE INVENTION

The present invention relates to a structure for a working machine of a bucket type excavator such as a hydraulic shovel. The present invention also includes a method for producing an arm of a bucket type excavator and the structure for the working machine of the bucket type excavator.

FIG. 1 depicts a hydraulic shovel which is a bucket type excavator. The bucket type excavation machine includes: an upper vehicle body 2 turnably mounted on a lower running body 1, a boom 3 vertically swingably mounted to the upper vehicle body 2, an arm 4 vertically oscillatably mounted to boom 3, and a bucket 5 vertically oscillatably mounted to a tip end of arm 4. A boom cylinder 6 is connected between the upper vehicle body 2 and boom 3. An arm cylinder 7 is connected between boom 3 and arm 4. A bucket cylinder 8 is connected between arm 4 and bucket 5.

During operation of the hydraulic shovel, boom 3 swings vertically, arm 4 and bucket 5 oscillate vertically. Upper vehicle body 2 turns laterally simultaneous with the bucket oscillation, thereby carrying out operations such as excavation and loading to a dump truck.

As shown in FIG. 2, arm 4 includes an arm body 10, an arm cylinder-mounting bracket 11 jointed to one longitudinal end of arm body 10, and a bucket-connection bracket 12 jointed to another longitudinal end of arm body 10.

As shown in FIG. 3, arm body 10 has a hollow and rectangular cross-section comprising an upper lateral plate 13, a lower lateral plate 14 and left and right vertical plates 15, 15.

As shown in FIG. 1, during operation of the excavation machine a vertical load F1, a lateral load F2, a torsion load F3 and the like are applied to arm 4. Durability against these loads is secured by choosing proper dimensional constraints on arm body 10. For example, referring to FIG. 3, load F1 can be stabilized by appropriately choosing dimensions for the arm body cross-sectional width W, cross-sectional height H, as well as appropriately choosing the thicknesses of upper lateral plate 13, lower lateral plate 14 and left and right vertical plates 15, 15. These dimensions and thicknesses are appropriately set in accordance with the magnitude of the loads shown in FIG. 3. In addition, lateral load F2 and torsional load F3 can be compensated for by adding a cross-section restraint member such as a rib 16 shown in FIG. 2.

In hydraulic shovel excavation machines including an upper vehicle body 2 main portion, a boom 3, an arm 4 and a bucket 5, a counter weight 9 is provided at a rear portion of upper vehicle body 2. The amount of counter weight required for the excavation machine depends upon the weight of the machine. For Example, if the working machine is reduced in weight, the weight of the counter weight 9 mounted to the rear portion of the upper vehicle body 2 can be reduced, the rearward projecting amount of the upper vehicle body 2 can be reduced and therefore, a turning radius of the rear end of the upper vehicle body 2 can be reduced.

If the working machine comprising boom 3, arm 4 and bucket 5 is reduced in weight, it is possible to increase the volume of the bucket correspondingly instead of reducing the weight of the counter weight 9 and thus increasing the working amount of the machine.

Further, arm 4 is vertically swung by arm cylinder 7, and a portion of a thrust of arm cylinder 7 supports the weight of arm 4. Therefore, if arm 4 is reduced in weight, the thrust of arm cylinder 7 is effectively utilized as the vertical swinging force of arm 4. Similarly, the weight of arm 4 is applied to boom cylinder 6. Thus, if arm 4 is reduced in weight, the thrust of boom cylinder 6 is effectively utilized.

In generally, when considering the strength of a working machine of the bucket type excavator, as the simplest method, the working machine is replaced with a beam or a thin pipe which is discussed in material mechanics and a strength with respect to the bending and torsion can be evaluated.

That is, the bending stress and shearing stress applied to a cross-section can be obtained by the following general formulas (1) and (2):

$$\sigma = M/Z \tag{1}$$

(wherein, σ: bending stress on a cross-section, is determined from M: bending moment of a cross-sectional area subject to bending stress, and Z is a cross-section coefficient)

$$\tau = T/(2 \cdot A \cdot t) \tag{2}$$

(wherein, τ: shearing stress, is determined from T: torsion torque, A: projection area of neutral line of cross-section plate thickness, t: thickness of cross-section plate)

An appropriate shape of the cross-section can be determined from the results of the above calculation and permissible stress of the material to be used. Similarly, deflection of the beam and torsion of the axis can be calculated using general formula of the material mechanics, and such calculation, rigidity of the working machine can also be evaluated.

However, if a working machine designed in accordance with the above evaluation method is actually produced and stress tests are carried out, in many cases the results of the tests are different from the calculated stress values. For this reason, in recent years, stress is evaluated by a computer simulation using finite element method (FEM). Computer simulations result in enhancing the precision in stress evaluations. When stress is calculated using an FEM simulation, it can be found that a cross-sectional area of a working machine, which was previously considered as a beam and axis of material mechanics, is actually changed in shape before and after the load is applied. As a result of this, it is understood that a stress calculated using the general formulas of material mechanics based on the presumption that the shape of a cross-sectional material is not changed and a stress measured during an actual stress test do not coincide with each other.

In the case of a conventionally used working machine having a rectangular cross-section, there are two factors for determining a deformation strength of the cross-section, i.e., rigidity of a rectangular angle portion and rigidity of a rectangular side portion in the outward direction of a surface. When each of the two rigidities do not have sufficient strength, an excessive load applied to the rectangular angle portion causes the cross-section to deform as shown in FIG. 5. To prevent deformation, a cross-section restraint material such as a partition wall is required for a portion in which the cross-section deforms. However, when a cross-section restraint material is provided the productivity of the working machine is lowered.

Referring now to FIG. 3, if the above facts are applied to arm 4 which has a hollow rectangular cross-section, rigidity of the cross-section is determined by bending rigidity of an angle portion (a) and bending rigidity (rigidity in the outward direction of surfaces) of the four surfaces (upper lateral plate 13, lower lateral plate 14, and left and right vertical plates 15 and 15).

That is, influence of the bending rigidity of the surfaces and the bending rigidity of the angle portion is great with respect to the deformation of the cross-section. As shown in FIGS. 3 and 4, when lower plate 14 is fixed and a load F (shown with arrow F) is applied, each of the angled portions (a) are bent and deformed. Upper plate 13, left vertical plate 15 and right vertical plate 15 are bent and deformed in the outward direction of the surfaces (thickness direction). When the thickness of the plate is reduced, reduction of rigidity in the outward direction of the surface is proportional to the third power of a ratio of reduction of the plate thickness.

For the above discussed reasons, if the thickness of each plate is reduced to increase the cross-section of arm 4, the rigidity of the entire boom is largely lowered. As depicted in FIG. 3 with arrows b and c, lateral load F2 and torsion load F3 apply force to arm 4 causing lightweight boom 3 to deform. Therefore, to prevent deformation in the arm, the cross-section must be reinforced in accordance with the above described restraint material such as partition wall 16 and pipe 17. The weight of the boom is increased because of the reinforced cross-section restraint material. The structure of the arm is complicated because of the addition of partition wall 16 and pipe 17. Additionally, there is a problem with producing the excavation machine due to an increase in welding portions.

Furthermore, as shown in FIG. 2, arm 4 is provided with a bucket cylinder bracket 17 for connecting bucket cylinder 8 and a boom cylinder-connection boss 18 for connecting boom 3. If the thickness of each of portions to which these are to be connected (e.g., left and right vertical plates 15, 15 and upper lateral plate 13) is reduced, the rigidity in the outward direction of the surface is lowered. Therefore, in some cases, the deformation in the outward direction of the surface is further increased, the rigidity of arm 4 is reduced, and a deformation (shown with a phantom line in FIG. 3) is produced. Thus, it is difficult to reduce the thickness of the plate material which forms arm body 10.

Further, since the plate members forming the arm body 10 are welded to one another at right angles, if the thickness of the plate members is reduced, the weld jointing efficient is lowered, and it is difficult to secure the durability of the angle joint and thus, it is difficult to reduce the thickness of the plate members forming the arm body 10.

Furthermore, in the case of a conventional boom, upper lateral plate 13, lower lateral plate 14 and left and right vertical plates 15, 15 are formed by cutting them in accordance with the shape of arm body 10. Vehicle arm cylinder bracket 11 and bucket-connection bracket 12 are welded to arm body 10. The method of producing a conventional boom is complicated since: working of each of the plate members is complicated, the welding portion (welding line) is long, and many steps are required to produce the boom.

As shown in FIG. 5, a conventional boom is produced by bending one sheet of a plate (d) into a U-shape. The U-shaped material forms upper lateral plate 13 and left and right vertical plates 15, 15 as a single unit. However, multiple forming steps are required in this case. More specifically, a step for cutting plate d and lower lateral plate 14, a step for bending plate d into a U-shape, and a step for welding two welding portions (welding lines) is required. Thus, many steps are required in manufacturing the conventional boom and this method is complicated.

OBJECTS AND SUMMARY OF THE INVENTION

It is an object of the present invention to provide a structure for a working machine of a bucket type excavator capable of solving the above problem.

It is another object of the present invention to provide a method of producing an arm of a bucket type excavator and a structure for a working machine of a bucket type excavator.

Briefly stated, an arm body of a working machine has a hollow and triangular cross-section. A bucket-connection bracket is jointed to one longitudinal end of an arm body, and an arm cylinder bracket is jointed to another longitudinal end of the arm body, thereby forming an arm. With the triangular cross-sectional structure, the arm body is less prone to deformation under the stress of a load. The improved triangular cross-sectional structure permits the plate thickness of the arm body to be reduced, and the rigidity of the arm body to be increased without mounting a cross-section restraint material in the arm body. The cross-section of the boom will not deform even though the plate thickness is reduced. Therefore, it is possible to reduce the weight of the boom and still prevent deformation of the boom under heavy load. A method of producing an arm body is efficient and simplified since a single sheet of metal may be formed into a triangular shape, with a single welded seem being formed at the seem between abutting edges of the metal material. The various corners of the triangular cross-section may be arc shaped or flat as is desired.

It is an object of the present invention to provide a structure for a bucket-type excavator hydraulic shovel working machine comprising a hollow elongated body, and the elongated body has a substantially triangular shaped cross-section.

It is another object of the present invention to provide a structure for a bucket-type excavator hydraulic shovel working machine comprising: a boom, a bucket, the boom having a tip end side, the boom having a hollow triangular shaped cross-section, and the bucket is mounted to the tip end side of the boom such that the bucket is pivotally supported by the boom.

It is a feature of the invention to provide a method of producing an arm body for a bucket-type excavator working machine, comprising the steps of: bending a plate material having two long sides and two short sides to form a first hollow member with a triangular cross-section, abutting the two long sides of the first hollow member to form butted portions, and welding the butted portions of the two long sides to form butt-welded portion of the arm body.

It is another feature of the invention to provide a method of producing an arm body for a bucket-type excavator working machine, comprising the steps of: bending a plate material having two long sides and two short sides to form a first hollow member with a triangular cross-section, abutting the two long sides of the first hollow member to form butted portions, welding the butted portions of the two long sides to form butt-welded portion of the arm body, where the arm body has a cross-section in which three sides are straight, each straight side is connected to another straight side by a connected portion, each connected portion having an arc shape, the cross-section is a triangular shaped cross-section, the triangular shaped cross-section has a lower surface forming a base side of a triangle, the triangular shaped cross-section has an upper surface formed at a tip of the triangle, and the butt-welded portions of the two long sides are disposed on the lower surface.

The above, and other objects, features and advantages of the present invention will become apparent from the following description read in conjunction with the accompanying drawings, in which like reference numerals designate the same elements.

DETAILED DESCRIPTION OF THE INVENTION

Figure 1:
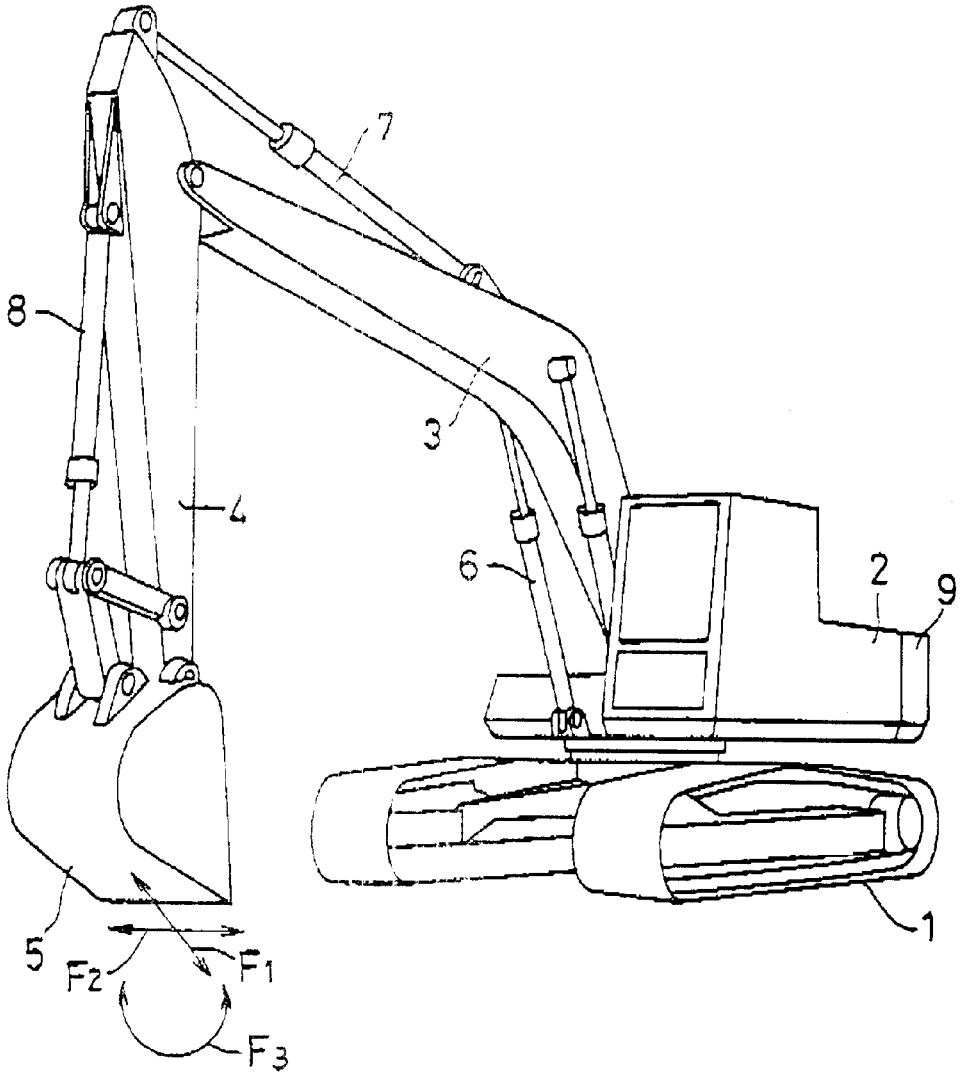
FIG. 1 is a perspective view of a power shovel.
Figure 2:
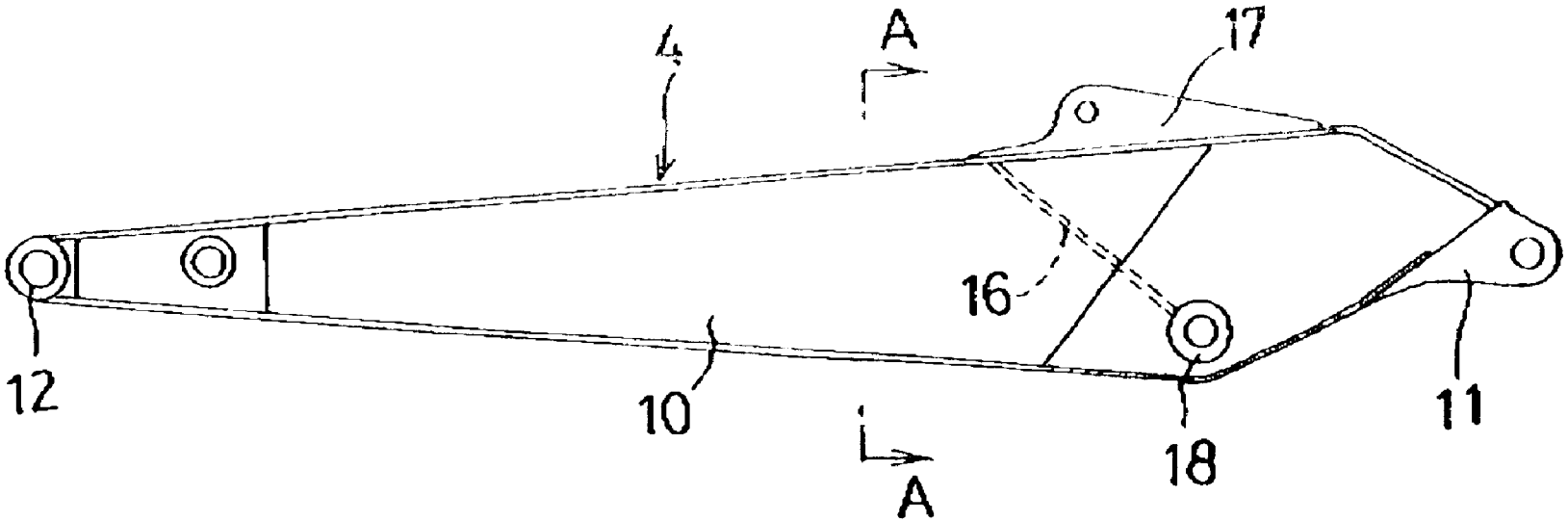
FIG. 2 is a front view of a conventional arm.
Figure 3:
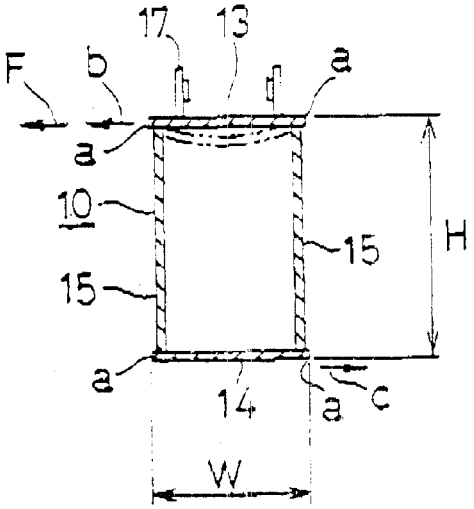
FIG. 3 is a sectional view taken along the line A—A in FIG. 2.
Figure 4:
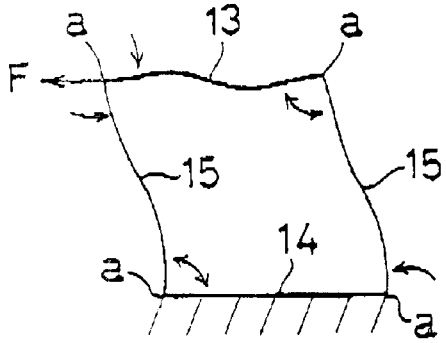
FIG. 4 is an explanatory view of deformation of a cross-section of the arm.
Figure 5:
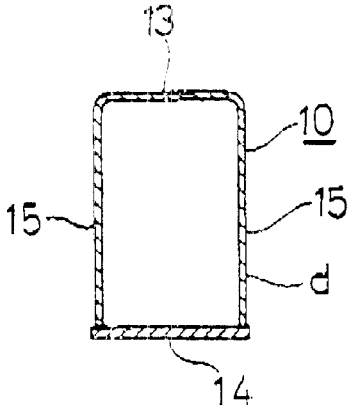
FIG. 5 is a sectional view showing another example of the arm.

According to a first embodiment of the invention, there is provided for an arm of a bucket type excavator for a working machine such as a hydraulic shovel excavation machine. The arm body has a cross-section in which three straight sides are formed with connecting portions located between adjacent sides. The three straight sides form a generally triangular cross-sectional area. The connecting portions formed between the straight sides are arc shaped.

Since the boom body has a triangular shaped cross-section, the cross-sectional area is less prone to deformation in the outward direction of the surface by load. Thus, the boom body maintains it's cross-sectional shape and rigidity without using a cross-section restraint material such as a pipe. The plate thickness of the boom body can be reduced resulting in reduced weight. Since it is unnecessary to use a cross-section restraint material (such as a partition wall and/or a pipe) the structure is simplified and the number of portions requiring welding is small. Therefore, the first embodiment of the invention provides for a device with a reduced boom weight, enhanced durability and excellent producability.

According to a second embodiment of the invention, there is provided for an arm body which has a cross-section in which three straight sides are formed with connecting portions located between adjacent sides. The three straight sides form a generally triangular cross-sectional area. The connecting portions formed between the straight sides are arc shaped. The cross-sectional area can be increased such that it inscribes a sectional area of a conventional structure. As a result of the arc-shaped angled portions, the cross-section performance can be maintained and stress can be dispersed. Therefore, the second embodiment of the invention results in a device in which a large sectional area can be secured, the cross-section performance can be maintained, and the rigidity of the boom can be enhanced.

In an arm of a bucket type excavator according to a third embodiment of the invention, a bucket is mounted to a tip end side and pivotally supported by a boom, wherein the arm body is hollow and triangular in cross-section. Since the arm body has a generally triangular shaped cross-section, due to characteristics that a triangle cross-section is less prone to be deformed in the outward direction of surface by load, the arm body can keep its cross-section shape and secure the rigidity without using a cross-section restraint material such as a pipe. The plate thickness of the arm body can be reduced to reduce weight, the use of a cross-section restraint material such as partition wall and a pipe is unnecessary resulting in a simplified structure, and the number of portions requiring welding is small. Therefore, the third embodiment of the invention results in a device in which the weight of the boom can be largely reduced, and the durability and productivity of the boom are excellent.

In an arm of a bucket type excavator according to a fourth embodiment of the invention, an arm body has a cross-section as described above in the third embodiment of the invention in which three sides are straight, and each of connected portions of the two sides is of arc shape. Since the cross-section of the arm body has three sides are straight, and each of connected portions of the two sides is of arc shape, the sectional area can be increased such that it inscribes a sectional area of a conventional boom. The cross-section performance can be maintained, and since the angle portion is arc shaped, stress can be dispersed. Therefore, according to the fourth embodiment of the invention, a large sectional area can be secured, cross-section performance can be maintained, and the rigidity of the boom can be enhanced.

In an arm of a bucket type excavator according to a fifth embodiment of the invention, the arm body has a substantially triangle cross-section of the fourth embodiment of the invention in which a lower surface forms a triangular base side, an upper surface forms a tip of the triangle, and a boom mounting bracket is jointed to a longitudinal lower surface.

According to the fifth embodiment of the invention, the boom mounting bracket is affixed to the boom and also mounted to the lower surface of the arm body. The lower surface side is shorter in length and closer to the bracket than the upper surface side. If a lateral load (F2 in FIG. 1) or a torsion load (F3 in FIG. 1) is applied to the arm tip end, there is a tendency for the burden of the load to be exerted on the lower surface side. Therefore, as in the fifth embodiment of the invention, if the lower surface is formed into a base of the triangle, the performance of the cross-section can be exhibited more efficiently as compared with a structure which is turned upside down, and the weight can be further reduced. Also, when a vertical load (F1 in FIG. 1) is applied to such a boom, if the lower surface is the bottom surface of the triangle, the performance of the cross-section can be exhibited more efficiently.

An arm of a bucket type excavator according to a sixth embodiment of the invention includes the cross-section of the fifth embodiment of the invention discussed above. A bucket cylinder bracket is jointed to an upper surface of the arc connected portion of the two sides. Since the top of the arm body has high rigidity, the boom will not deform even though the plate thickness of the mounting portion of the bucket cylinder bracket is thin. With this structure, the plate thickness of the mounting portion of the bucket cylinder bracket of the arm body can be thinned to further reduce the weight of the boom.

An arm of a bucket type excavator according to a seventh embodiment of the invention includes the cross-sectional shape of the fifth embodiment of the invention. The arm body has a substantially triangle cross-section in which a lower surface forms a triangular base side, an upper surface forms a tip of the triangle, and a bucket cylinder bracket is jointed to the flat portion of the top. The top of the arm body is the flat portion. When the bucket cylinder bracket is welded to the flat top, edge preparation of the bucket cylinder bracket is unnecessary and the throat depth of the weld joint can be secured by using a fillet weld joint. The welding operation of the bucket cylinder bracket to the top of the arm body is facilitated. Even if the plate thickness is thin, the welding strength can be maintained.

An arm of a bucket type excavator according to an eighth embodiment includes the features of the sixth or seventh embodiments of the invention. In addition, a bucket-connection bracket is jointed to one longitudinal end of the arm body and an arm cylinder bracket is jointed to another longitudinal end of the arm body. The eighth embodiment of the invention produces an arm which is suitable for carrying out the invention.

According to a ninth embodiment of the invention, there is provided for a method of producing a structure for a working machine of a bucket type excavator. The method comprises the steps of: bending a plate material having two long sides and two short sides, thereby forming a hollow member which is triangular in cross-section, and welding butted portions of the two long sides, thereby forming a body. Since one sheet of plate material is bent and the butted portions are welded to form the structure body, the working of the plate material is easy, and the welding portions (welding line) is short. According to this method, the producing steps of the structure for the working machine are simple and the structure can be easily produced.

According to a tenth embodiment of the invention, there is provided for a method of producing a structure for a working machine of a bucket type excavator according to the ninth invention. In addition, the body has a cross-section in which three sides are straight, the connecting portions between two sides are arc shaped, the body has a triangle cross-section in which a lower surface forms a triangular base side, an upper surface forms a tip of the triangle, and butt-welded portions of the two long sides are disposed on the lower surface. Because the welding portion is disposed on the lower surface, the outward appearance is enhanced in addition to the merits which can be obtained by the boom of the first to third embodiments of the invention.

DETAILED DESCRIPTION OF THE PREFERRED EMBODIMENT

Figure 6:
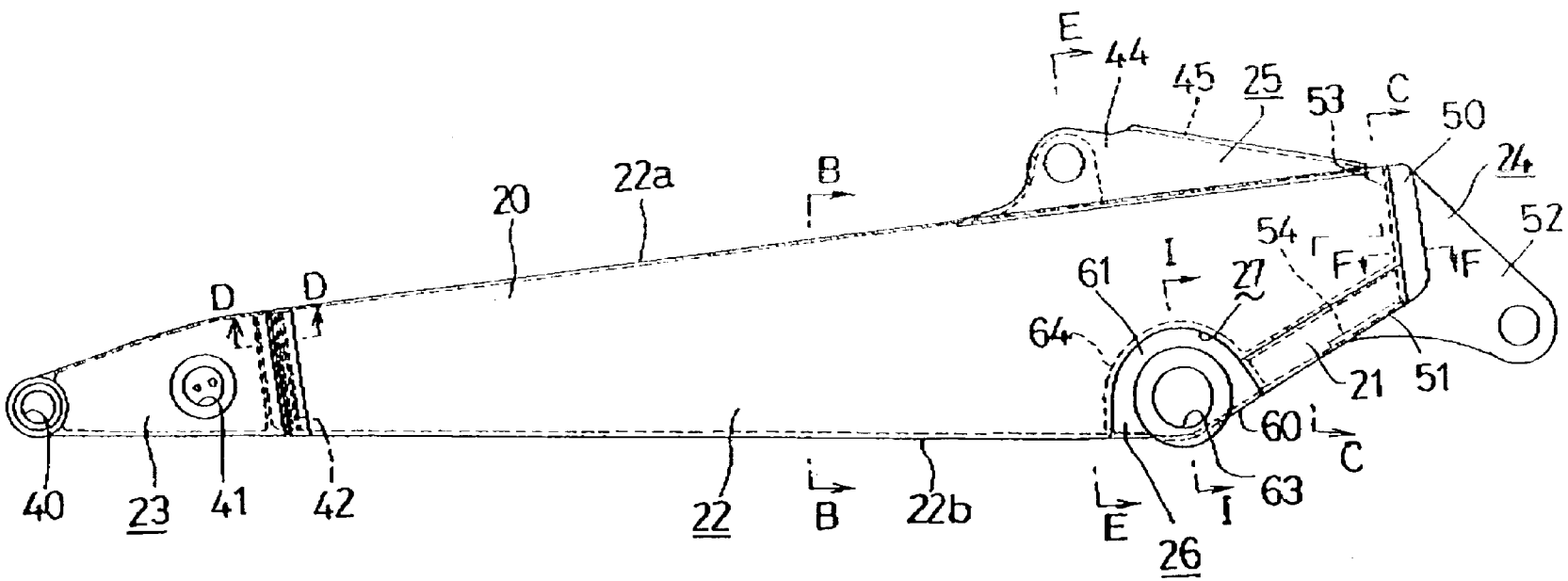
FIG. 6 is a front view of a arm of an embodiment of the present invention.
Figure 7:
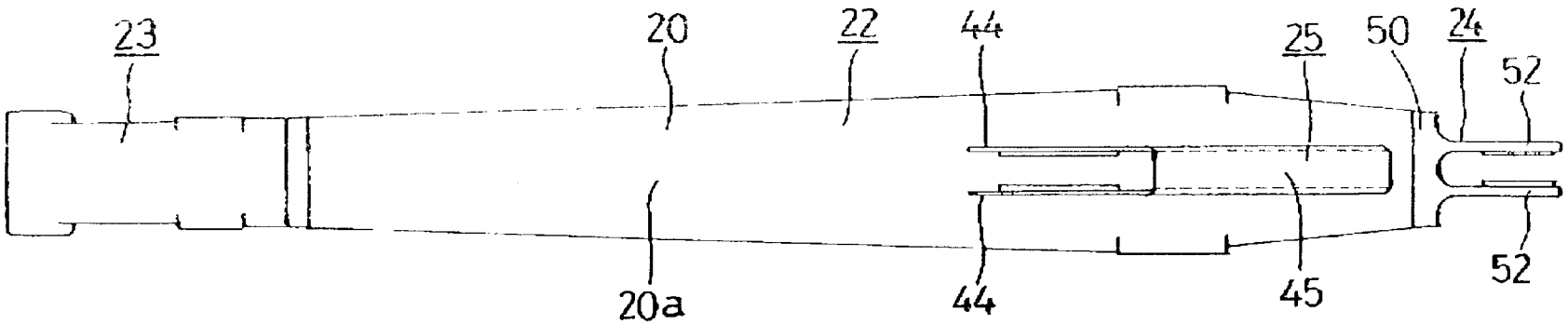
FIG. 7 is a plan view of the arm of the embodiment of the present invention.

As shown in FIGS. 6 and 7, an arm body 22 includes: a main arm body member 20 and an auxiliary member 21, a bucket-connection bracket 23 jointed to one longitudinal end of arm body 22, an arm cylinder bracket 24 jointed to another longitudinal end of arm body 22, a bucket cylinder bracket 25 jointed to an upper surface of arm body 22, a boom mounting bracket 26 jointed to an intermediate lower longitudinal portion of arm body 22, thereby forming an arm 4.

An upper surface 22*a* of arm body 22 is straight. A lower surface 22*b* of arm body 22 is formed in a substantially V-shape. The V-shaped lower surface 22*b* is bent at the intermediate longitudinal portion (connected portion of the boom connection bracket 26). Opposite longitudinal ends of arm body 22 are tapered in the height direction from the intermediate longitudinal portion. Opposite longitudinal ends of arm body 22 are also tapered in the width direction from the intermediate longitudinal portion.

That is, in arm body 22, the intermediate longitudinal portion has the greatest cross-section, and a cross-section of arm body 22 is gradually reduced toward the opposite longitudinal ends.

Figure 8:
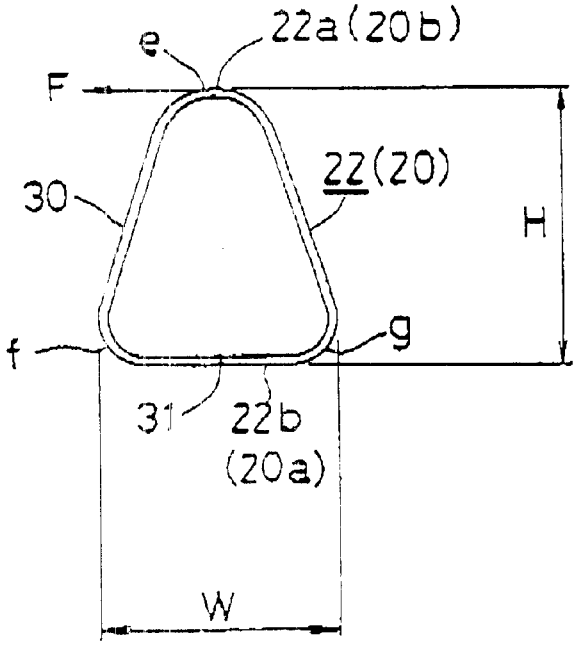
FIG. 8 is a sectional view taken along the line B—B in FIG. 6.
Figure 9:
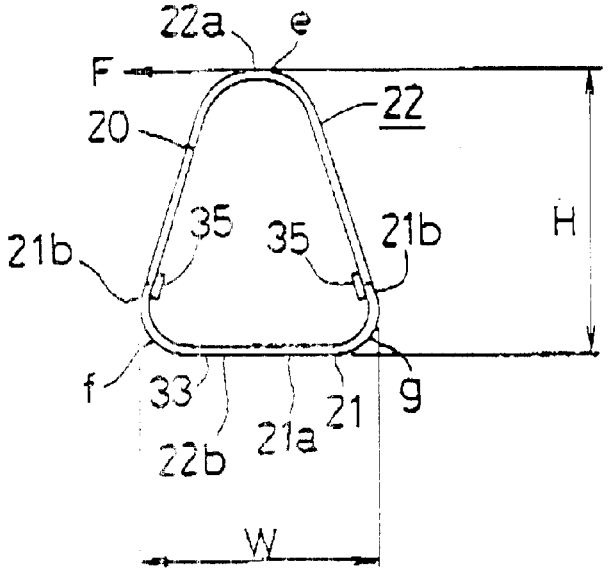
FIG. 9 is a sectional view taken along the line C—C in FIG. 6.

As shown in FIGS. 8 and 9, arm body 22 has a hollow and triangular shaped cross-section. A base side of the triangle forms a lower surface 22*b*. A top of the triangle forms an upper surface 22*a*. An intermediate longitudinal portion of the lower surface 22*b* of the arm body 22 is formed with arc notch 27. Boom connection bracket 26 is jointed to notch 27.

Figure 10:
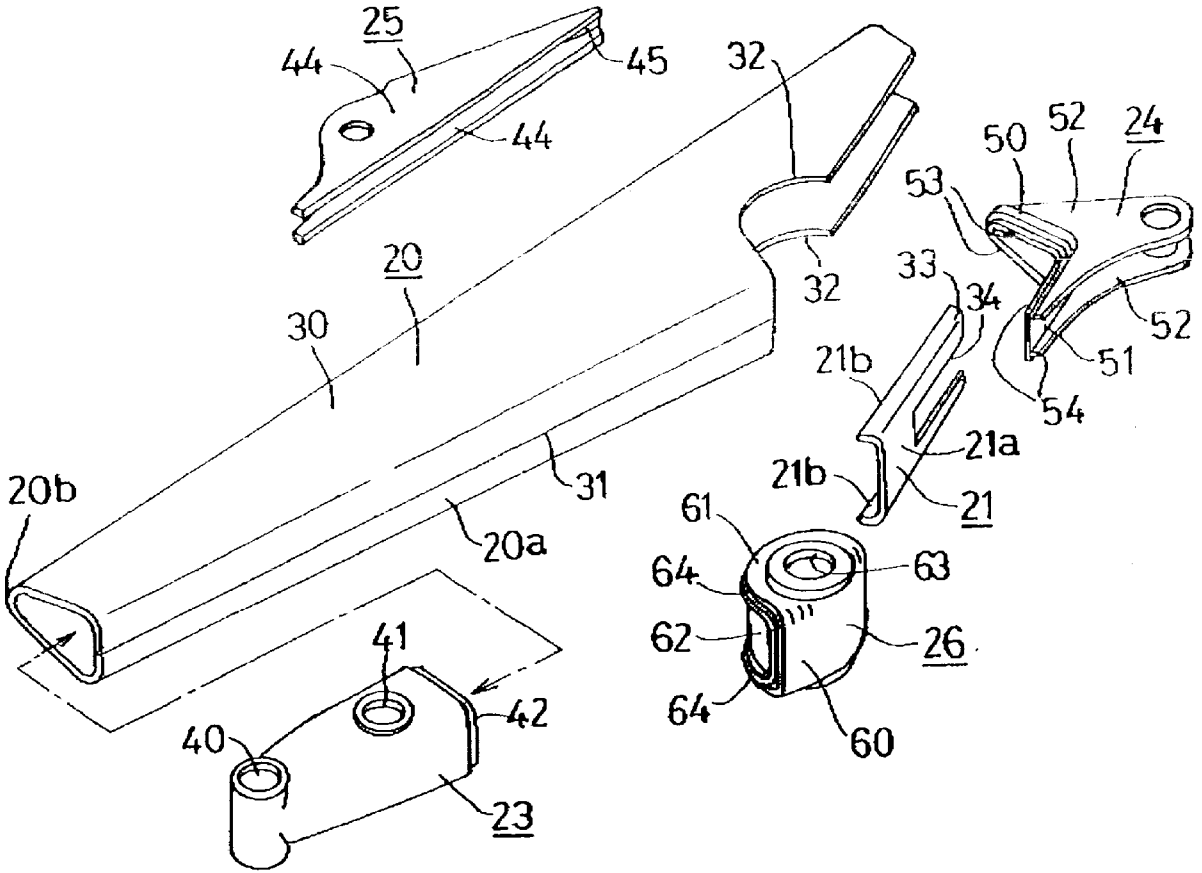
FIG. 10 is an exploded perspective view of the arm.

More specifically, as shown in FIGS. 8 and 10, a first portion of the arm is closer to a front end than the intermediate longitudinal portion, and includes only the main arm body member 20 and has a triangular cross-section. As shown in FIGS. 9 and 10, a second portion of the arm is closer to the rear end thereof than the intermediate longitudinal portion, and includes main arm body member 20, auxiliary member 21, and has a triangular cross-section.

Arm body 22 is formed in an isosceles triangle shape whose height H is greater than its width W. The three sides of the triangle are straight. Connecting portions e, f, and g are located between adjacent sides of the triangle and are arc shaped. A curvature of the upper connected portion e is greater than those of the lower connected portions f and g. With this structure, stress applied to each of the connected portions is dispersed, a cross-section performance required for a beam is secured, and vertical rigidity of the arm body is enhanced.

As shown in FIGS. 8 and 10, arm body member 20 is formed from one sheet of steel plate material 30. Plate material 30 is cut into a predetermined shape such that the material may be bent to form a shaft. Portions of the shaft which are closer to the front end than the intermediate longitudinal portion are butt-welded together forming a front portion. The front portion has a triangular cross-sectional shape. The rear portion of the shaft is angle shaped with an open lower surface. A bottom side of the triangle forms a lower surface 20*a*. A top of the triangle forms an upper surface 20*b*. Welded portion 31 is continues along the base side of the triangle in the longitudinal direction.

Opposing side vertical plates are formed at a rear end of main arm member 20. The opposing vertical plates taper at a low angle towards the rear end of main arm member 20. Arc shaped recesses 32 are formed in the vertical plates.

As shown in FIG. 10, auxiliary member 21 is obtained by cutting a steel plate 33 into a predetermined shape, and forming the steel plate 33 into a substantially U-shaped member. The U-shaped member has a lateral plate 21*a* and a pair of vertical pieces 21*b*, 21*b*. Lateral plate 21*a* is formed with a notch 34.

As shown in FIG. 9, vertical pieces 21*b*, 21*b* of auxiliary member 21 are welded to the opposite sides vertical plates closer to the rear end of main arm body member 20 through a backing plate 35. The pieces form a triangular shaped cross-section.

As shown in FIG. 10, bucket-connection bracket 23 is hollow and has a triangular shaped cross-section. A front end of bucket-connection bracket 23 is formed with a pin insertion hole 40. An intermediate opposite side surface of bucket-connection bracket 23 is formed with a pin engaging hole 41. A rear end of bucket-connection bracket 23 is integrally provided with a triangular shaped connection projection 42.

Figure 11:
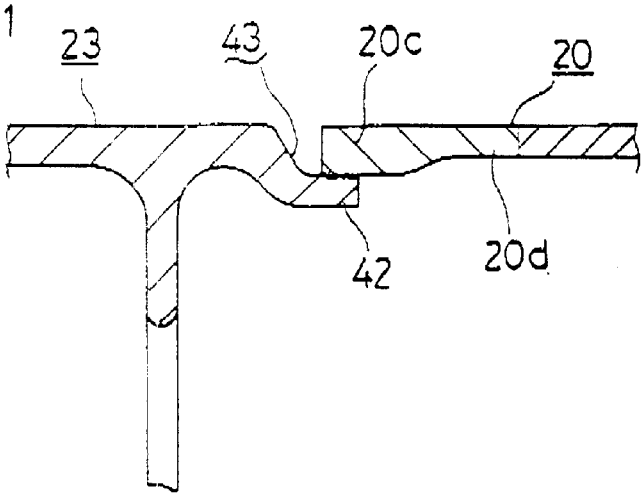
FIG. 11 is a sectional view taken along the line D—D in FIG. 6.

FIG. 11 shows further details of the interface between main arm body member 20 and bucket-connection bracket 23. As shown in the figure, one longitudinal end opening edge of main arm body member 20 (arm body 22) is fitted to a connection projection 42 of bucket-connection bracket 23. At the interface between the connection projection and the bucket-connection bracket a welding groove 43 is formed. Welding groove 43 permits the respective portions to be welded together. One longitudinal end edge 20*c* of main arm body member 20 is thicker than other portion 20*d* so that the thickness at the throat of the weld-joint secures a sufficient welding depth to provide a strong weld. With this structure, even if the plate thickness of the main arm body member 20 is reduced to reduce overall weight, the bucket-connection bracket 23 will be strongly welded.

Figure 12:
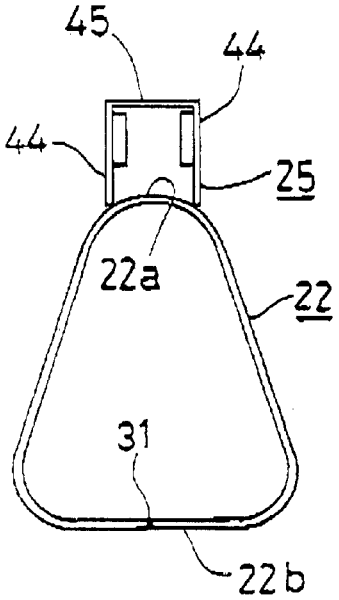
FIG. 12 is a sectional view taken along the line E—E in FIG. 6.

As shown in FIGS. 10 and 12, bucket cylinder bracket 25 has a U-shape in which a pair of vertical pieces 44, 44 are connected with a lateral piece 45. The pair of vertical pieces 44, 44 are welded to arc shaped upper surface 22*a* of arm body 22. The rigidity of the mounting portion of bucket cylinder bracket 25 of arm body 22 is secured by utilizing this structure. Even if the plate thickness of this portion is thin, it will not deform in reaction to the force of the bucket cylinder.

Referring again to FIG. 10, arm cylinder bracket 24 includes a mounting portion 50 of the same triangle shape as the other longitudinal end edge of the arm body 22. A lateral plate 51 is integrally formed with a lower portion of mounting portion 50. A pair of vertical pieces 52, 52 are integrally provided between mounting portion 50 and lateral plate 51.

Figure 13:
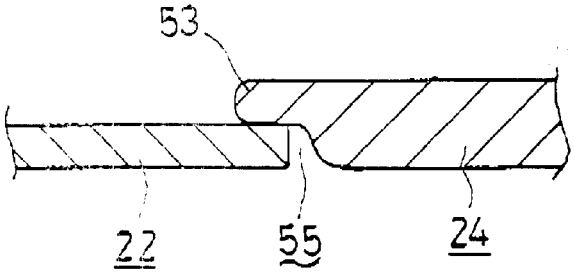
FIG. 13 is a sectional view taken along the line F—F in FIG. 6.

Mounting portion 50 includes an integrally formed triangular connection projection 53. Lateral plate 51 is integrally provided with a substantially U-shaped connection projection 54. U-shaped connection projection 54 is formed contiguously with connection projection 53. As shown in FIG. 13, the connection projection 53 is fitted to the other longitudinal end opening edge of arm body 22 to form and weld a welding groove 55.

Figure 14:
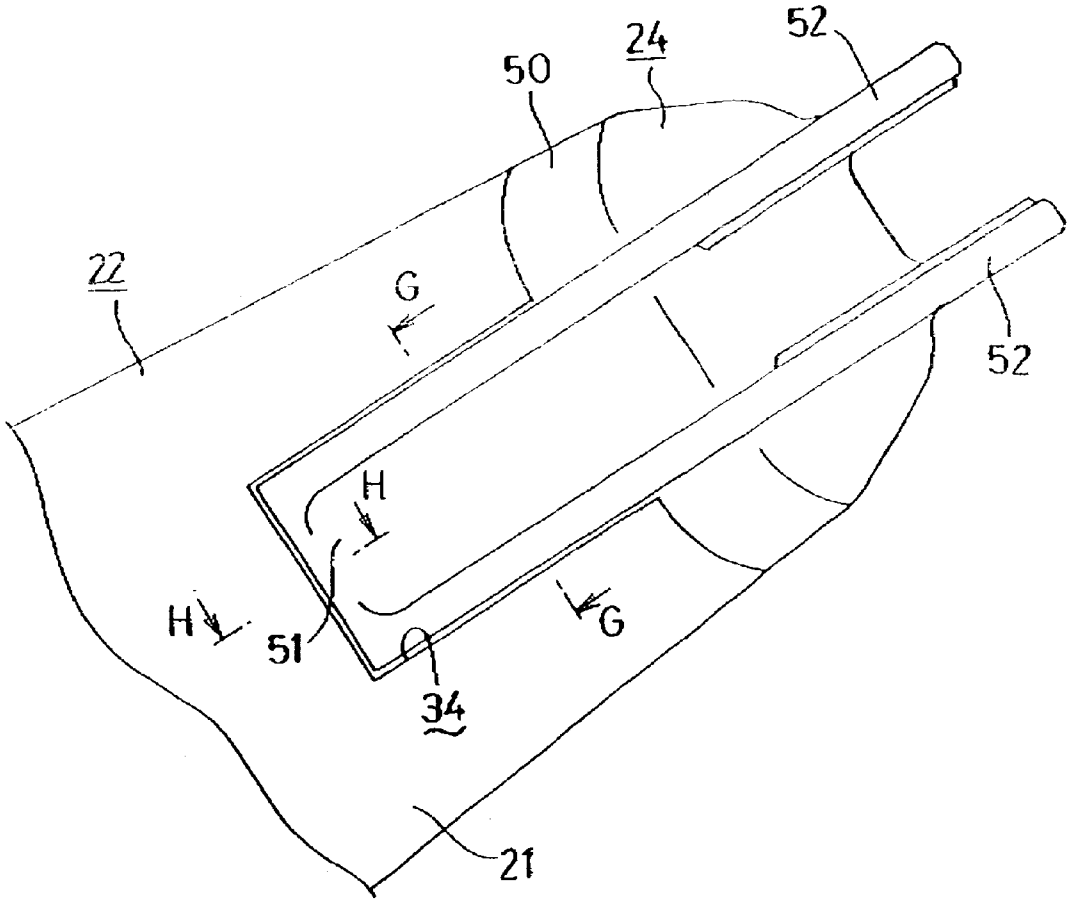
FIG. 14 is a bottom view of an end of the arm.
Figure 15:
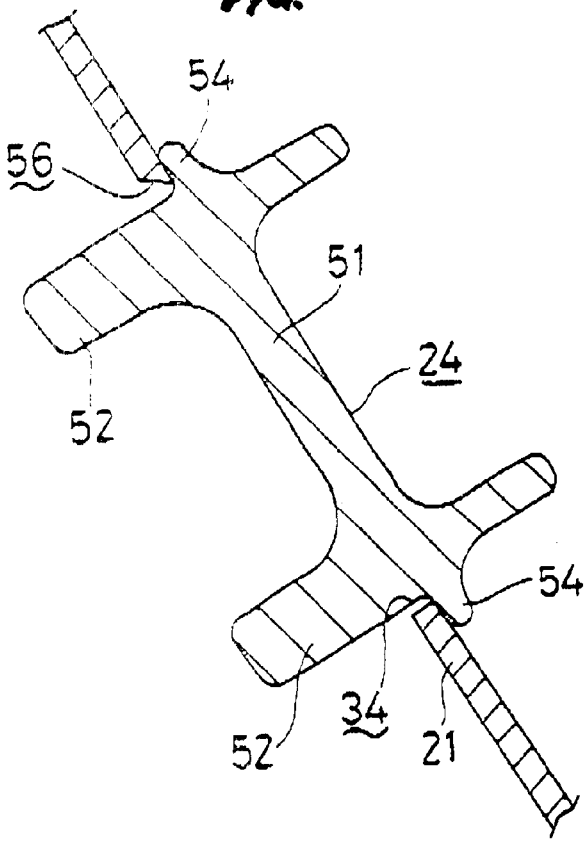
FIG. 15 is a sectional view taken along the line G—G in FIG. 14.
Figure 16:
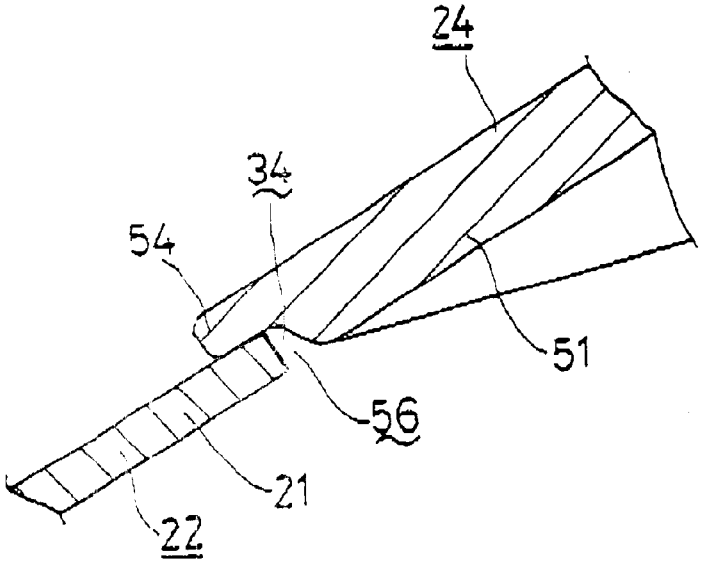
FIG. 16 is a sectional view taken along the line H—H in FIG. 14.

As shown in FIGS. 14–16, connection projection 54 of lateral plate 51 is fitted to notch 34 of auxiliary member 21 to form and weld a welding groove 56.

Figure 17:
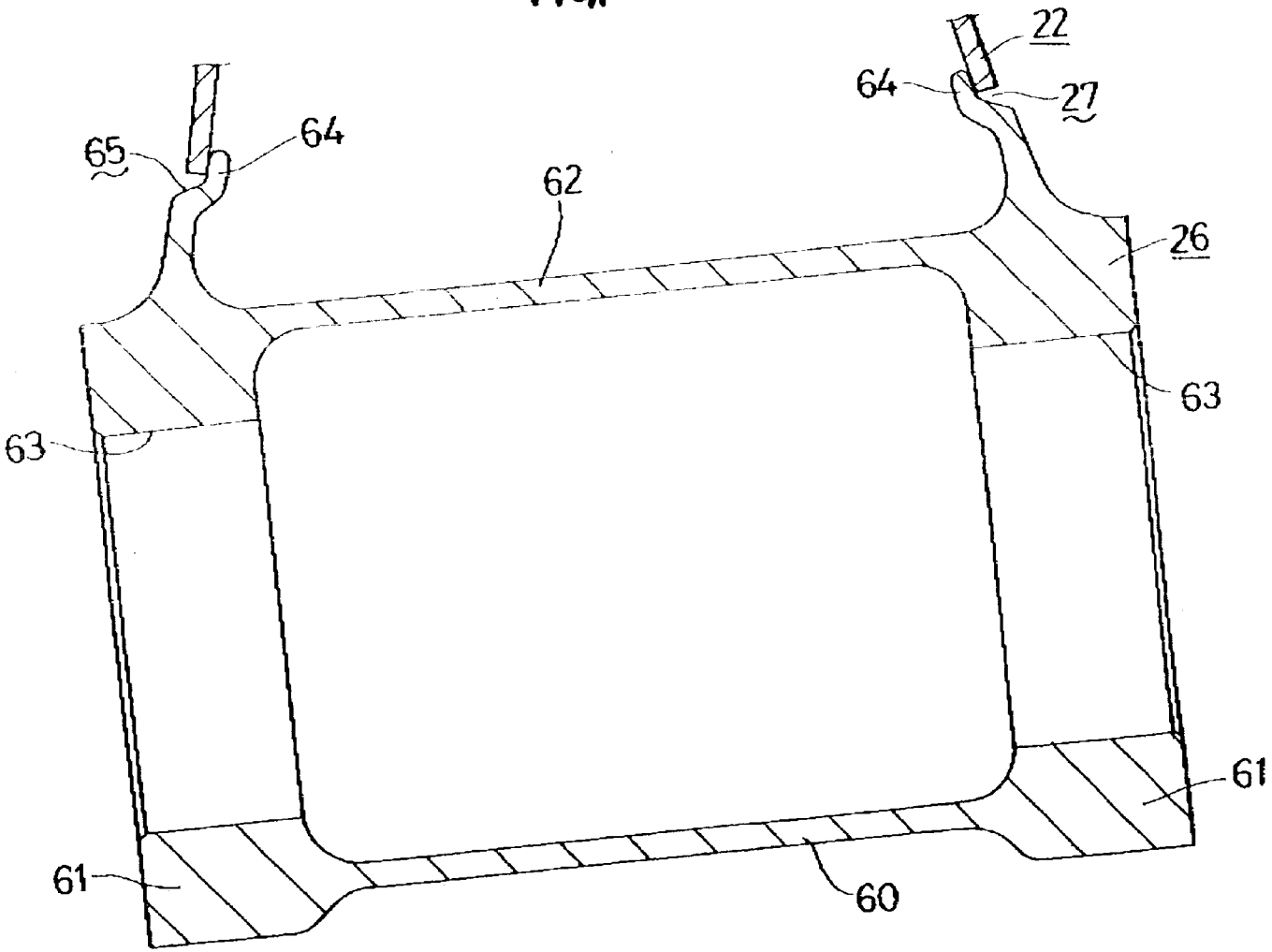
FIG. 17 is a sectional view taken along the line I—I in FIG. 6.

Referring now to FIGS. 10 and 17, boom-mounting bracket 26 is formed as a hollow structure comprising a lower lateral piece 60, a pair of vertical pieces 61, 61 and an arc shaped upper lateral piece 62. The pair of vertical pieces 61, 61 are formed about pin fitting holes 63. The pair of vertical pieces 61, 61 and the upper lateral piece 62 have an arc shape with the same curvature as arc notch 27 of arm body 22. Upper lateral piece 62 is integrally provided with an arc connection projection 64. Connection projection 64 is fitted to notch 27 of arm body 22 to form and weld a welding groove 65.

Figure 18:
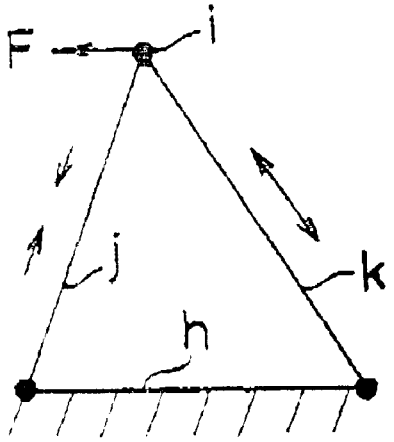
FIG. 18 is an explanatory view of a deformation of a cross-section of the arm.

As described above, arm body 22 has a triangular cross-section. Unlike a rectangular cross-section, deformation strength of a triangular cross-section is determined only by the rigidity in the inward direction, with respect to the surface, of each side of the triangle. For example, in FIGS. 8 and 9, when the base is fixed and load F (shown with an arrow) is applied to the top of the structure (shown schematically in FIG. 18), a compressing force is applied to one side j connecting base h and top i with each other. Applying the compression force to side j causes side j to shrink and deform. As side j deforms, a tensile strength is applied to side k causing side k to extend and deform. It is important to note that none of the forces are applied in the outward direction with respect to the surfaces of sides j and k. Since the rigidity (rigidity in the inward direction of the surface) against the tensile and compressing forces of sides j and k is greater than the bending forces in the outward direction of the surfaces, the rigidity of a triangular cross-section boom is greater than that of a rectangular cross-section boom.

In the general formula of the material mechanics, in the case of the strength of the working machine, if the size of the cross-section is increased, strength of cross-section can be secured even if the cross-section is rectangular or triangular. However, if deformation of the cross-section is taken into consideration as described above, in the case of the rectangular cross-section, the rigidity of the corner and the rigidity of the side in the outward direction of the surface are lowered in proportion to reduction of the plate thickness. Whereas, in the case of the triangular cross-section, the rigidity is lowered in proportion to a reduction ratio of the plate thickness. Therefore, variation in rigidity of the cross-section due to the reduction in plate thickness of a boom having a triangular cross-section is smaller than that of a boom having a rectangular cross-section.

The plate thickness of a conventional boom with a rectangular cross-section cannot be drastically reduced because of the undesirable effects of deformation under load. For the above discussed reasons, it is possible to drastically reduce the deformation characteristics of a triangular cross-section boom while reducing the plate thickness. Thus, it is possible to reduce the weight of a boom by using a triangular shaped cross-section.

Figure 19:
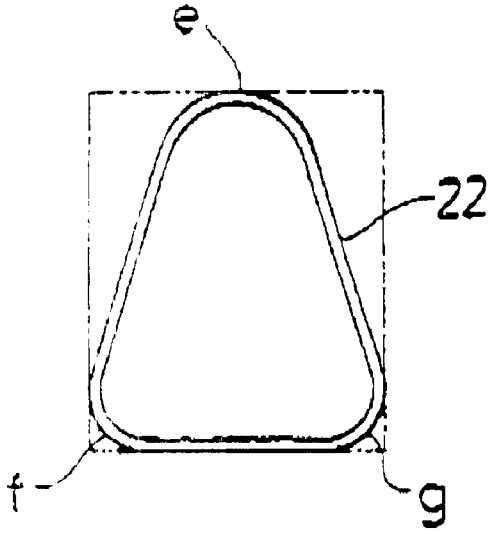
FIG. 19 is an explanatory view of a size of the cross-section of the arm.

As shown in FIGS. 8 and 9, the connected portions e, f, and g of the two sides of the triangular cross-section boom have an arced shape. Thus, the cross-sectional area of the boom can be increased sufficient to provide secure performance of the cross-section without deformation. Referring to the phantom line shown in FIG. 19, the cross-section can be increased by inscribing the arc connected portions e, f, g with rectangular inner surfaces of a space (height and width of the cross-section) limited by disposition of the working machine on a machine, visual recognition properties of an operator and the like.

When boom-mounting bracket 26 is mounted to the lower surface of arm body 22, the lateral load (F2 in FIG. 1) and/or the torsion load (F3 in FIG. 1) is applied to a tip end of the arm. Since the lower surface side is closer to bracket 26 than the upper surface side, there is a tendency for the lower surface side which is shorter in length to bear a greater amount of the load. As described previously, if the lower surface is formed into a base of a triangle, the cross-section exhibits more efficient performance as compared to a structure which is turned upside down, and the weight can be reduced further. Also, when the vertical load (F1 in FIG. 1) is applied to such a boom, if the lower surface is the bottom surface of the triangle, the cross-section exhibits more efficient performance.

Next, a method of producing a main arm body member will be explained.

Figure 20:
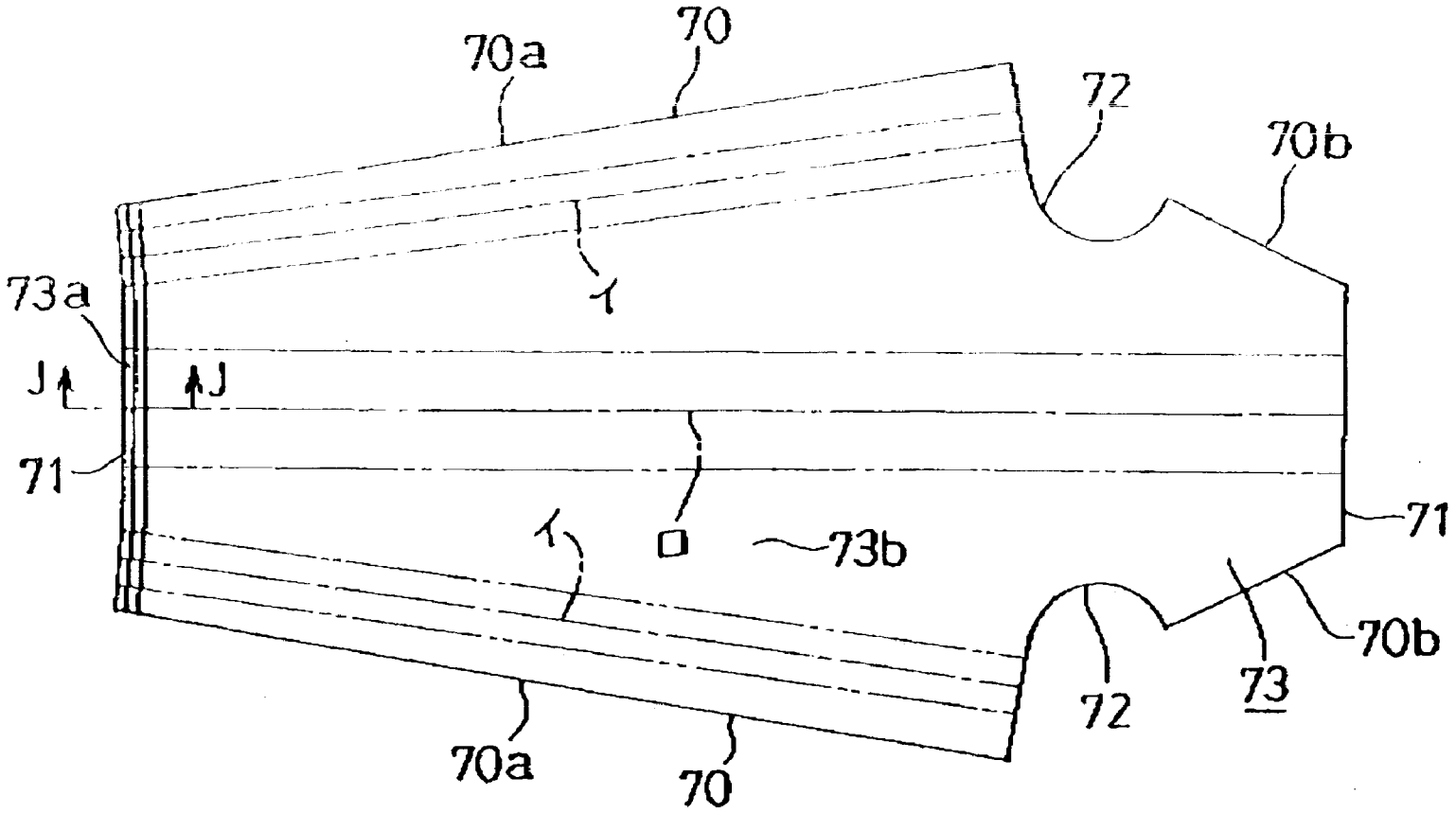
FIG. 20 is a plan view of a plate material for producing a main arm.
Figure 21:
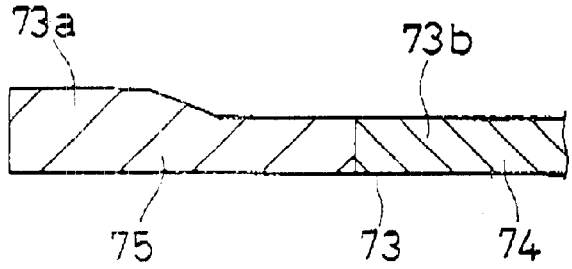
FIG. 21 is a sectional view taken along the line J—J in FIG. 20.

First, as shown in FIG. 20, a steel plate is cut into a substantially rectangular plate material 73 which is surrounded by two opposed long sides 70, 70, and two opposed short sides 71, 71. Each long side 70 is formed in substantially a V-shape. Each long side 70 includes one side portion 70*a* and another side portion 70*b*. Side portions 70*a* and 70*b* form a V-shape about an arc shaped notch 72. The thickness of plate material 73 is set such that opposing end 73*a* of the short side 71 is thicker than another portion 73*b*. More specifically, as shown in FIG. 21, bar materials 75 have thick portions and thin portions at one longitudinal end of plate 74 which is cut into the predetermined shape.

Figure 22:
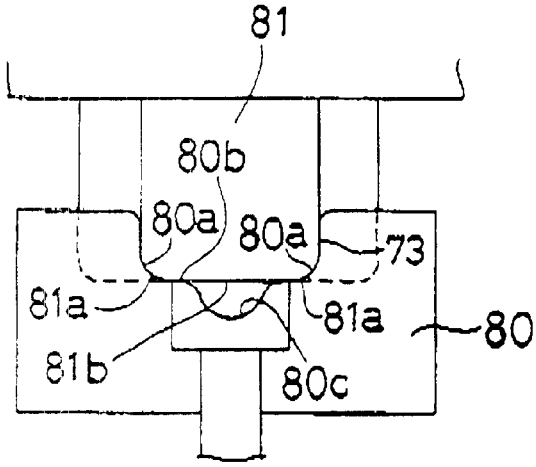
FIG. 22 is an explanatory view of bending operation of the plate material.
Figure 23:
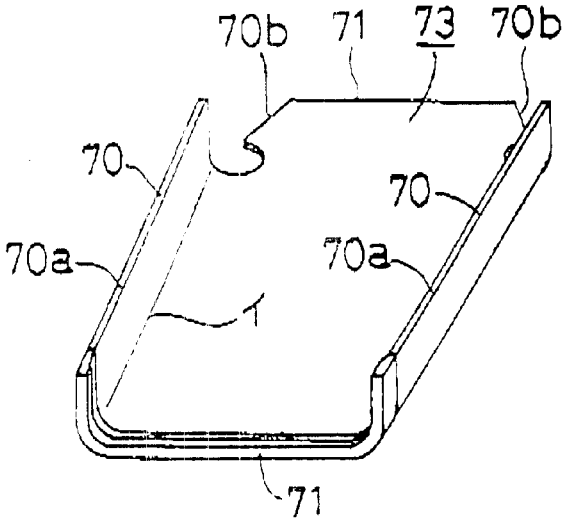
FIG. 23 is a perspective view of the bent plate material.

Second, as shown in FIG. 22, a die 80 and a punch 81 are used to bend and shape a plate material 72 into a prescribed shape. Die 80 includes two arced surfaces 80*a*, 80*a* which are connected by a straight surface 80*b*, and an arced surface 80*c* with a large curvature located at the center of straight surface 80*b*. Punch 81 also includes two arced surfaces 81*a*, 81*a* which are connected by another straight surface 81*b*. Plate material 72 is bent into an arc shape by bending lines A closer to the long sides of plate material 72 and thereby forming plate material 72 into a substantially U-shape structure as shown in FIG. 23.

Figure 24:
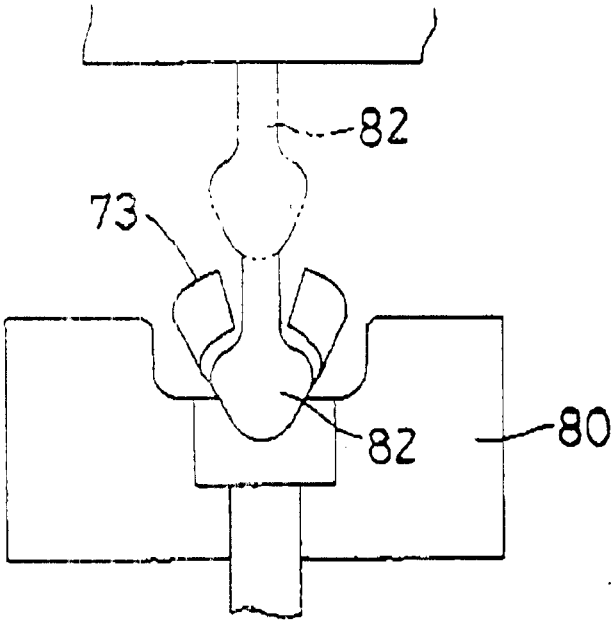
FIG. 24 is an explanatory view of bending operation of the plate material.
Figure 25:
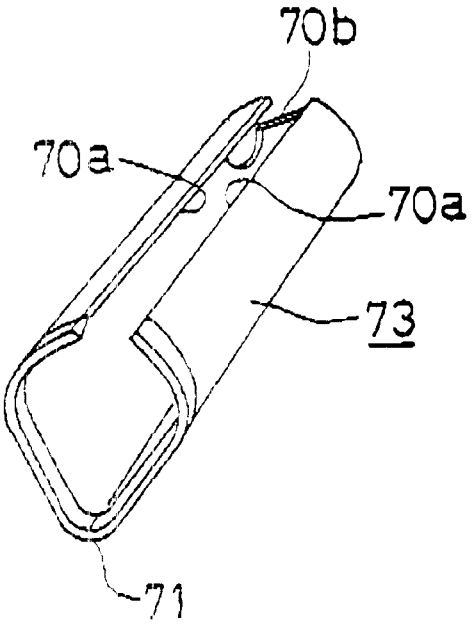
FIG. 25 is a perspective view of the bent plate material.

Third, as shown in FIG. 24, a center of plate material 72 is bent into an arc shape along a bending line B utilizing die 80 and another punch 82. Die 80 and punch 82 are used to form plate material 72 into a substantially rhombus shaped structure as shown in FIG. 25. Since the same die is used in this manner, no deviation in position occurs and precise bending is secured.

Figure 26:
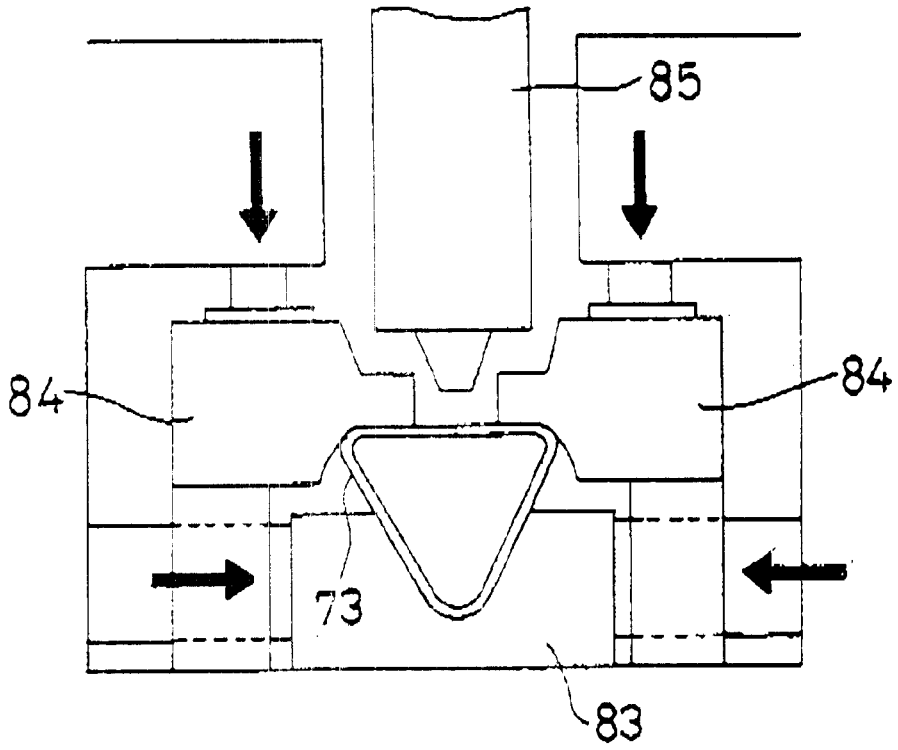
FIG. 26 is an explanatory view of bending and jointing operations of the plate material.
Figure 27:
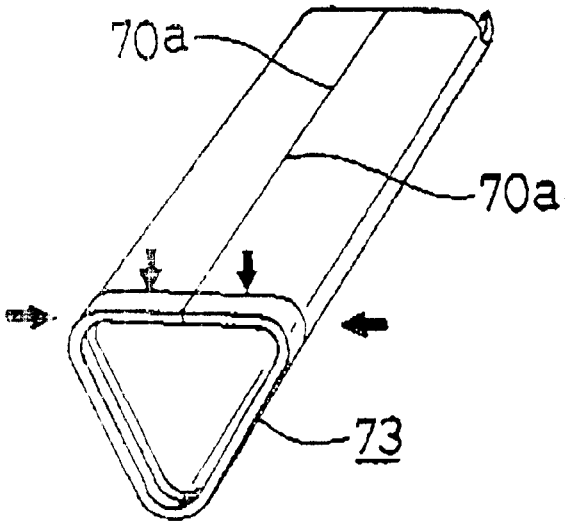
FIG. 27 is a perspective view showing jointed plate material.

Fourth, as shown in FIG. 26, bent plate material 72 is set on a die 83. A pair of punches 84, 84 are moved laterally and vertically to bend plate material 72 into a triangle shape. The two long sides 70, 70 of plate material 73 are butted against one another as shown in FIG. 27. While maintaining abutting edges 70*a*, 70*a*, a welding torch 85 is moved along a space between the pair of punches 84, 84 to weld the abutting portions. Since plate 73 is bent and formed into it's final shape and simultaneously welded, the butt precision of the welding portion can be secured.

Figure 28:
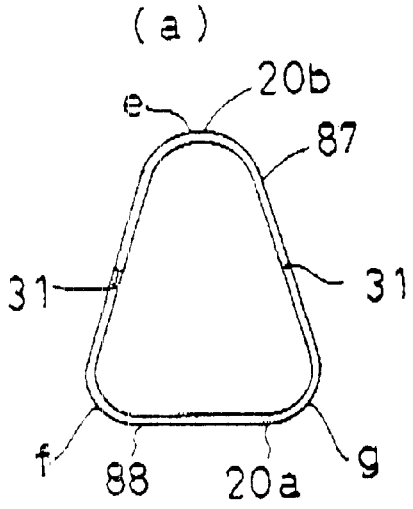
FIGS. 28(*a*) and (*b*) are explanatory views of another example of the arm body.
Figure 28:
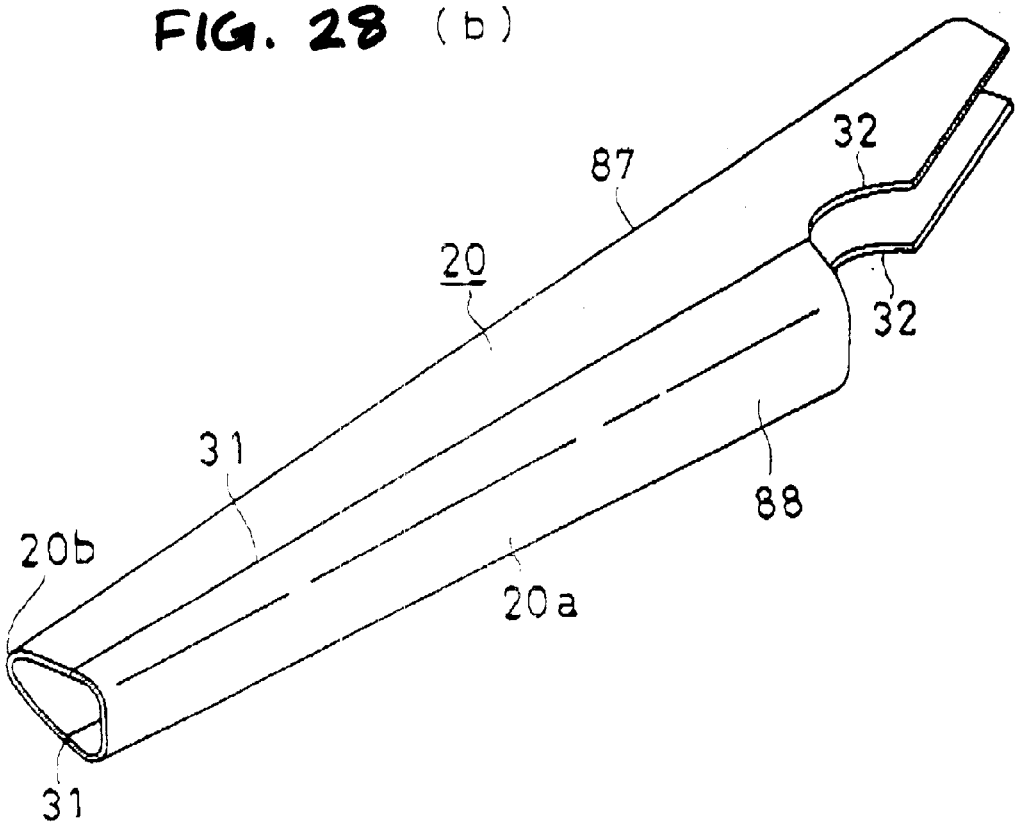

As shown in FIGS. 28(*a*), (*b*), main arm body member 20 (arm body 22) may be produced by bending two plate materials to form a top side member 87 and a bottom side member 88. The main arm body member 20 is formed by jointing members 87 and 88 together.

Figure 29:
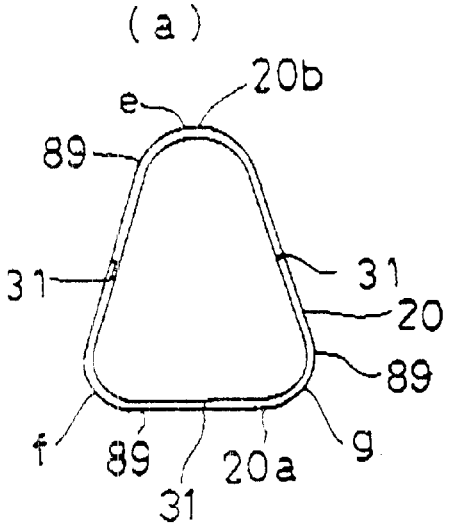
FIGS. 29(*a*) and (*b*) are explanatory views of another example of the arm body.
Figure 29:
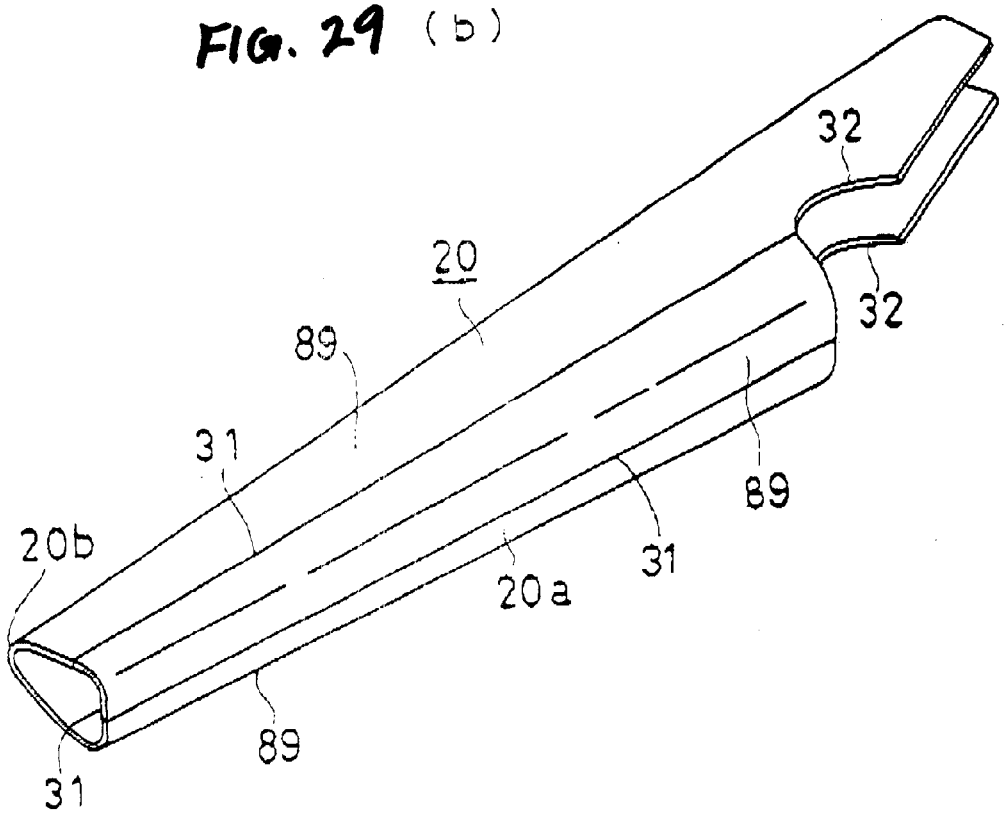

As shown in FIGS. 29(*a*), (*b*), the main arm body member 20 (arm body 22) may be produced by bending three plate materials to form three members 89. The main arm body member 20 is formed by jointing the three members together.

Figure 30:
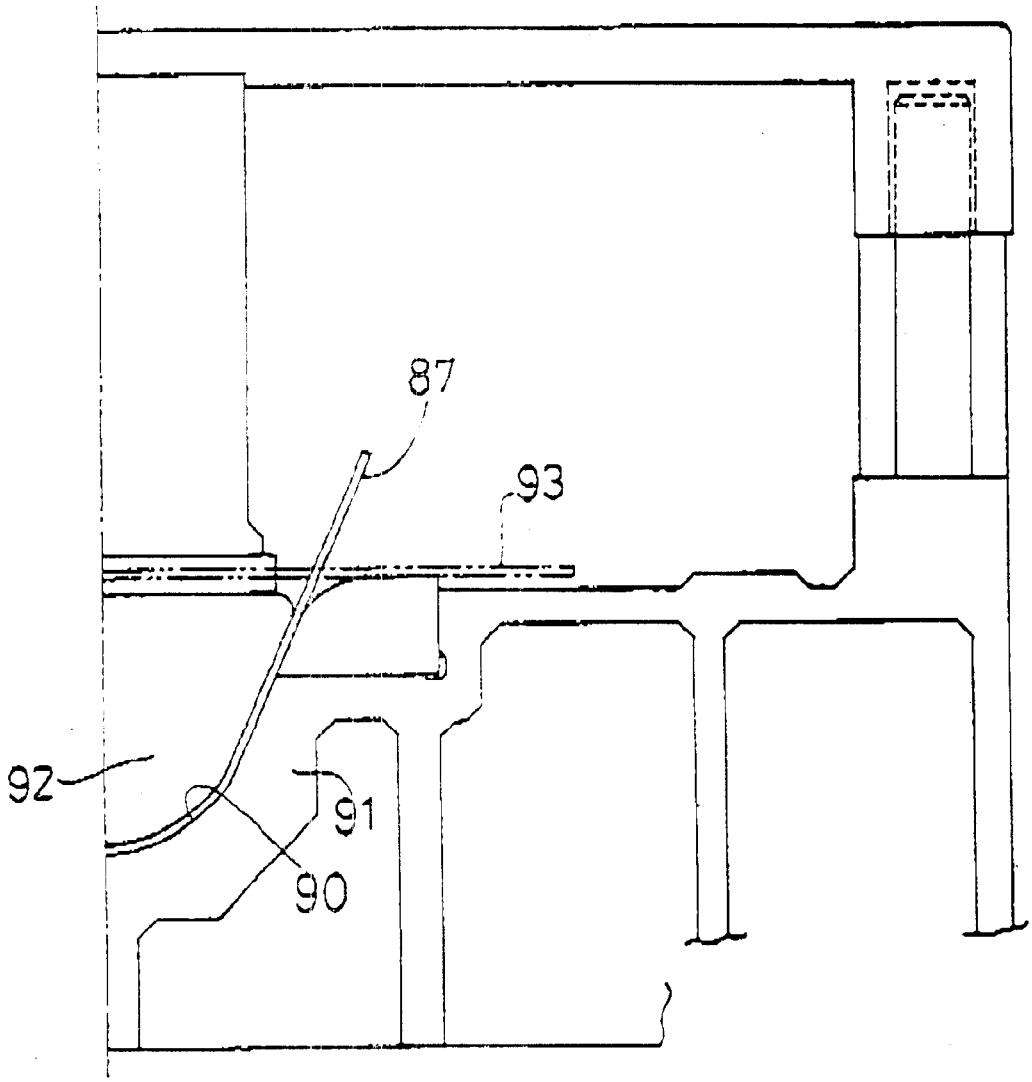
FIG. 30 is an explanatory view of bending operation of a top cross member.

When main arm body member 20 is produced using two plate materials as shown in FIGS. 28(*a*), (*b*), one plate material 93 is bent to form a top side member 87 using a die 91 and a punch 92 as shown in FIG. 30. Die 91 has a recess 90 whose base portion is of arced and substantially V-shaped. Punch 92 has the same shape as that of the recess 90 of die 91.

Figure 31:
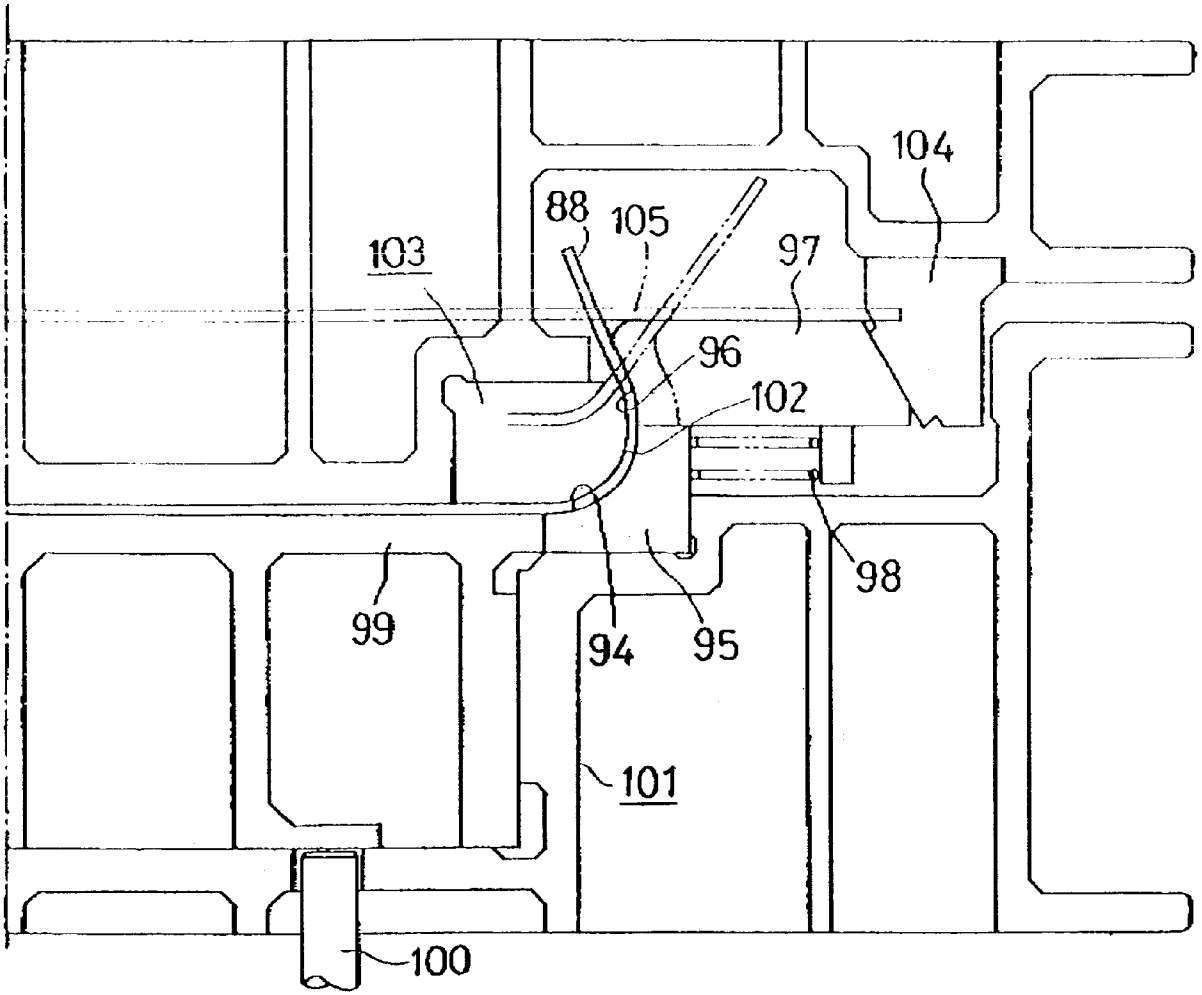
FIG. 31 is an explanatory view of bending operation of a bottom side cross member.

As shown in FIG. 31, a die 101 is formed using a stationary die 95 having an arced surface 94, a movable die 97 having an arced surface 96 which is connected contiguously with arced surface 94, a spring 98 for separating movable die 97 from stationary die 95, a cushion pad 99, and a cushion pin 100 for pushing up the cushion pad 99. A punch 103 having an arced surface 102, which is the same as the combined contiguous arced surfaces 94 and 96, is provided with a cam 104 which moves movable die 97 against spring 98. When punch 103 is in an upper position, cushion pad 99 is pushed up by cushion pin 100 and is flush with an upper surface of movable die 97.

A plate material 105 is bent using die 101 and punch 103, thereby forming a base side member 88. More specifically, plate material 105 is placed on movable die 97 and cushion pad 99, and punch 103 is lowered. While sandwiching plate material 105 between punch 103 and cushion pad 99, punch 103 is lowered and cushion pad 99 is lowered. Opposite ends of plate material 105 are sequentially bent by an arc portion 94 of stationary die 95.

When punch 103 is lowered to a predetermined position, movable die 97 is moved by cam 104 against spring 98. Plate material 105 is bent into a predetermined shape, thereby forming base side member 97.

Figure 32:
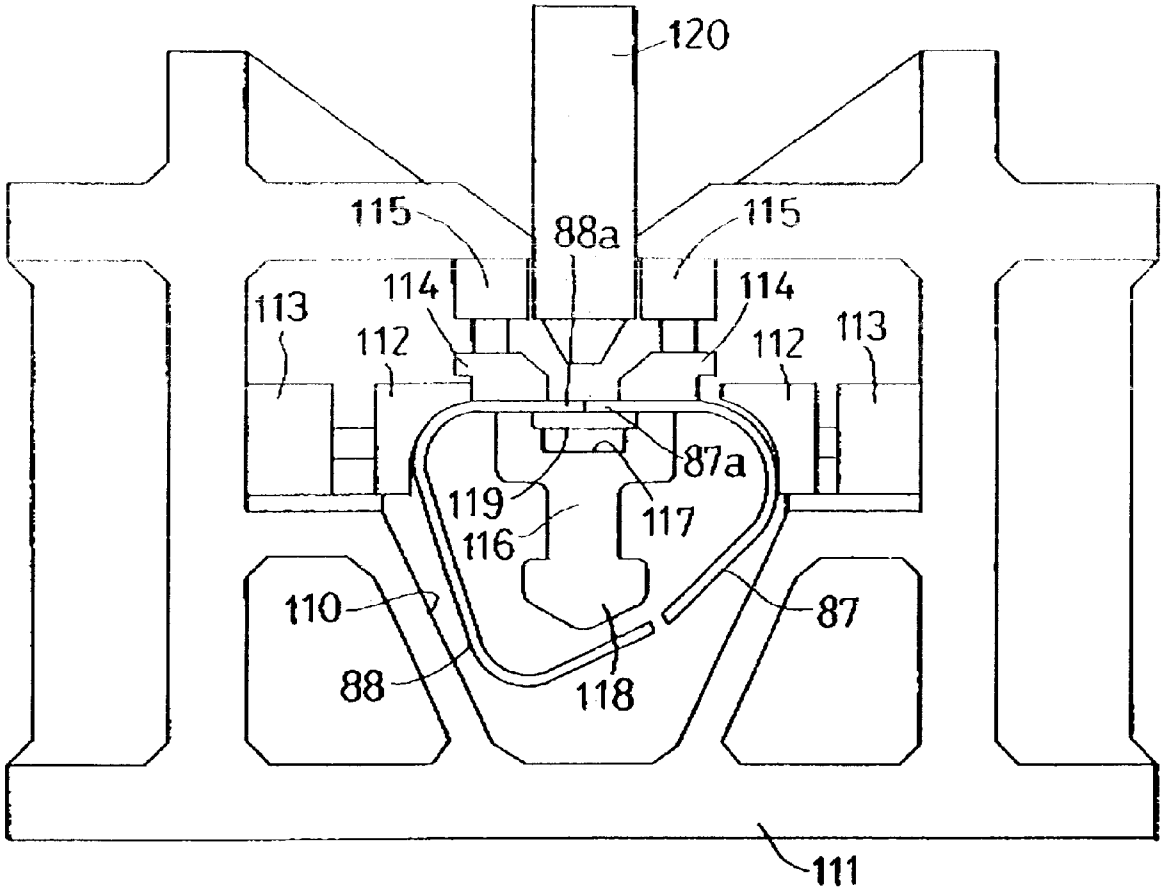
FIG. 32 is an explanatory view of back wave welding operation of one end of both members by a butt jig.

As shown in FIG. 32, a butt-jig is used to position top side member 87 and base side member 88 for proper abutment. The butt-jig permits the abutting members to be penetration-welded while in position.

The butt-jig includes: a body 111 having a V-shaped groove 110, a pair of side pushing pieces 112, 112 provided on opposing left and right sides of V-shaped groove 110 of body 111, a pair of first cylinders 113, 113 for moving side pushing pieces 112, a pair of upper pushing pieces 114, 114 provided on opposing upper sides of V-shaped groove 110 of body 111, a pair of second cylinders 115, 115 for moving upper pushing pieces 114, 114, and a backing material 116 provided along V-shaped groove 110 and supported by a supporting shaft (not shown) provided on opposing ends of body 111.

Backing material 116 includes a water-cooling jacket 117 and a lower supporting portion 118. Water-cooling jacket 117 includes an opening at an upper surface of backing material 116. A receiving plate 119 is mounted to an upper surface of backing material 116 to cover an upper portion of water-cooling jacket 117. Cooling water flows through water-cooling jacket 117. A welding torch 120 is movably mounted to an upper portion of V-shaped groove 110 of body 111.

The operation of penetration-welding will be explained as follows below. As described above, bent top side member 87 and base side member 88 are butted into a triangular shape and inserted between V-shaped groove 110 and backing material 116. Each side pushing piece 112 is moved inward toward a central region of the welder. Each upper pushing piece 114 is moved downward to press one end 87*a* of top side member 87 and one end 88*a* of base side member 88 against an upper surface of receiving plate 119. The abutted ends 87*a* and 88*a* are held in place by pushing pieces 112 and 114 while welding torch 120 is moved, thereby penetration-welding the butted portions together.

Upon completion of the penetration-welding step, each side pushing pieces 112 is moved sideways away from the central region and each upper pushing piece 114 is moved upward to release portions 87 and 88. Top side member 87 and base side member 88, which are now welded together at the abutment between ends 87*a* and 88*a,* are pulled out between V-shaped groove 110 and backing material 116.

Figure 33:
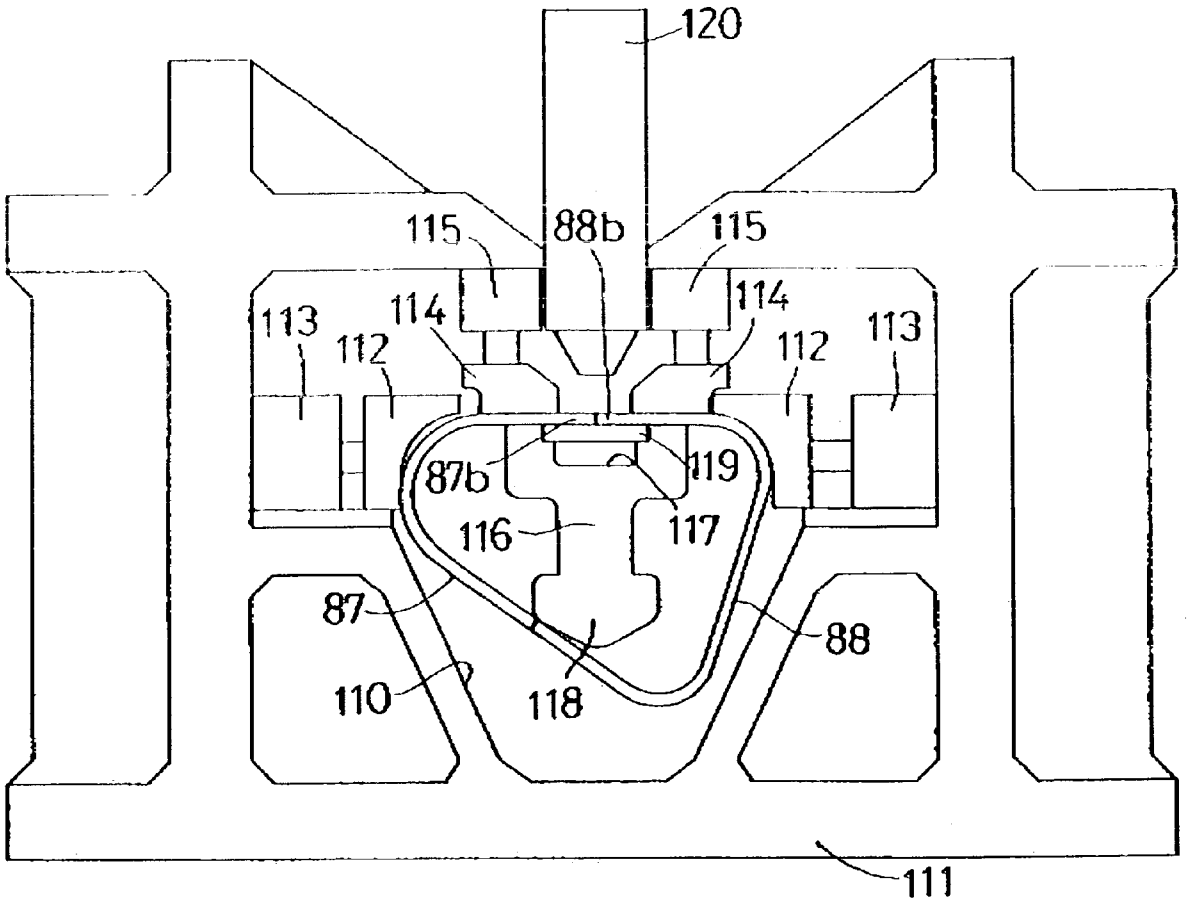
FIG. 33 is an explanatory view of back wave welding operation of the other end of both members by a butt jig.

Next, the pulled out top side member 87 and base side member 88 are rotated, and re-inserted between V-shaped groove 110 and backing material 116 as shown in FIG. 33. The other ends 87*b* and 88*b* are penetration-welded in the same manner as that described above.

With the above operation, a main arm body member 20 (arm body 22) comprising two members can be produced.

By using the butt-jig penetration-welding sequence described above a three-plate material boom member can be produced as shown in FIGS. 29(*a*), (*b*). One plate material is bent using die 91 and punch 92 as shown in FIG. 30 to produce three members 89. Subsequently, the three members 89 are sequentially penetration-welded at three points using the butt-jig shown in FIG. 32 to produce the boom member.

Figure 34A:
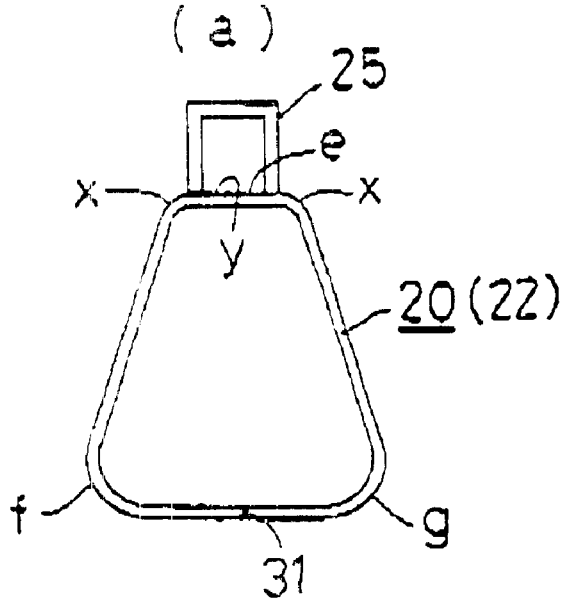
FIGS. 34(*a*) and (*b*) are sectional views showing different triangle shapes of the boom front member and the boom rear member.
Figure 34B:
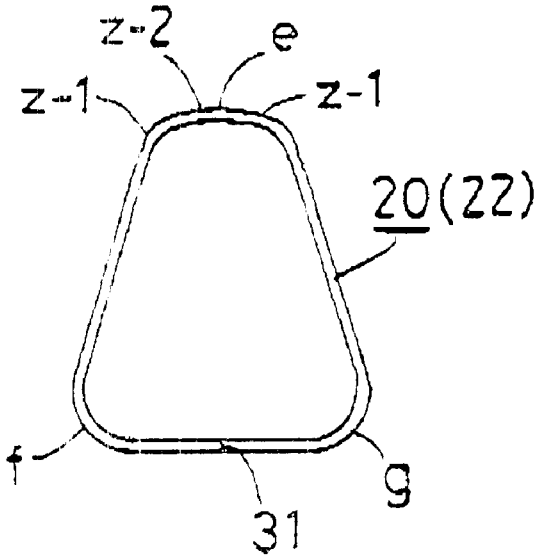

In addition, as shown in FIGS. 34(*a*) and (*b*), arm body 22 may be formed such that upper connected portions e are formed by two arc portions x, x, a flat portion y, and two arced portions z-1, z-1 having small curvatures, and an arced portion z-2 having a large curvature.

Although it is not illustrated, all three connected portions, or any one or two of them may be formed into the above-described shape, or each of the connected portions may have a different combination of shapes.

When the boom has a flat portion y as shown in FIG. 34(*a*), bucket cylinder bracket 25 can be welded to the flat portion y. Therefore, edge preparation of bucket cylinder bracket 25 is unnecessary and the throat depth of the weld joint can be secured by welding using a fillet weld joint.

Figure 35:
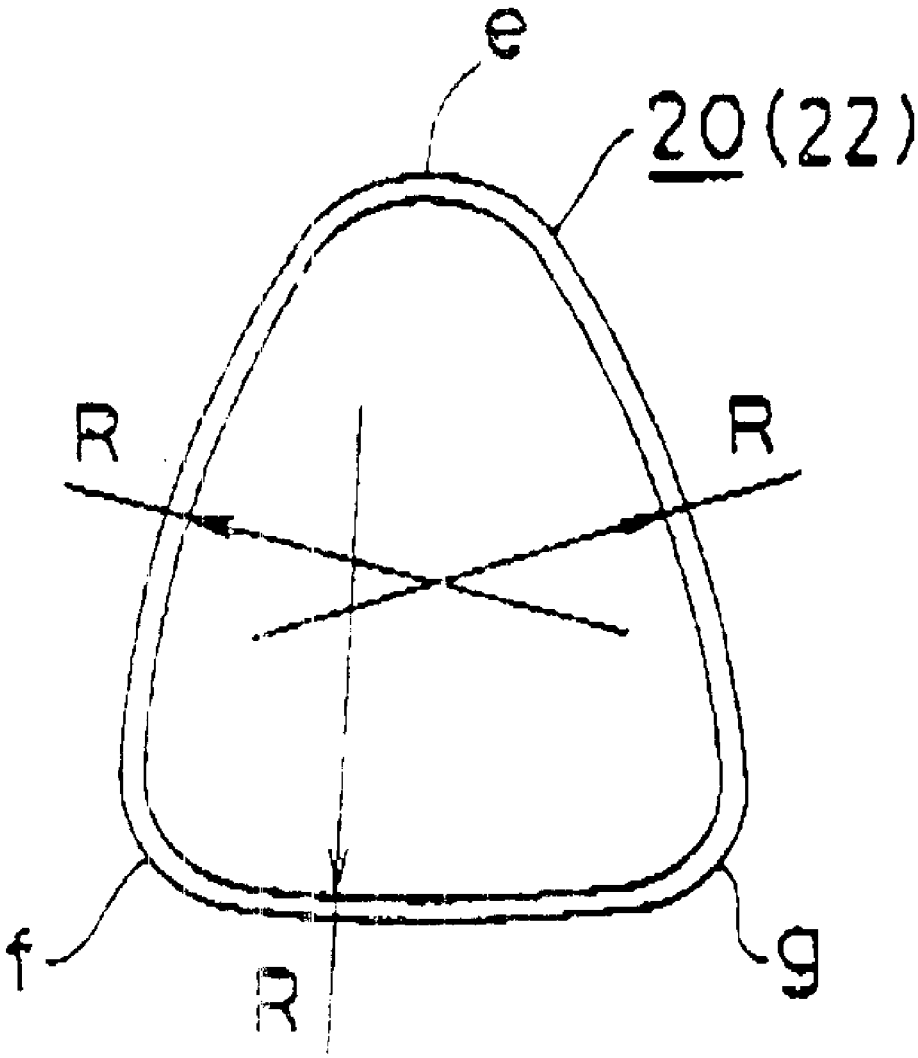
FIG. 35 is a sectional view showing another triangle shape of the boom front member and the boom rear member.

As shown in FIG. 35, arm body 22 (the main arm body member 20) may have three sides which bulge with large curvatures R instead of three straight sides. Alternately, the three sides may be any combination of bulged sides and straight sides.

The previously discussed weld joints are based upon on the notion that MAG (Metal ActiveGas) welding methods or MIG (Metal InertGas) welding methods are used. However, it is understood that it is possible to use high energy welding methods such as laser welding and electron beam welding by changing the weld joint. When a high energy density heat source is used, the thick portions provided on the opening edges 20*c* of boom front member 20 may be omitted so that these portions have the same thickness as that of the other portions 20*b*. Thus, connection projections 42, 53, 54, 55, 56 and 64 may be omitted, and the portions may be butted and penetration-welded.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims. While the above described embodiments discuss the case of a hydraulic shovel, the present invention can also be applied to bucket type excavators having different designs and to other structures for working machines in substantially the same manner.

What is claimed is:

1. A bucket-type working machine comprising:

a hollow elongated body;

said elongated body has a substantially triangular shaped cross-section;

said hollow elongated body is an arm of said bucket-type working machine; and said triangular shaped cross-section of said elongated body includes three straight sides;

each of said three straight sides are connected together by arc shaped portions.

2. A bucket-type working machine according to claim 1, wherein said bucket-type working machine is an excavator hydraulic shovel.

3. A structure for a bucket-type working machine comprising:

a boom;

a bucket;

said boom having a tip end side;

said boom having a hollow triangular shaped cross-section;

said bucket is mounted to said tip end side of said boom such that said bucket is pivotally supported by said boom.

4. A bucket-type working machine according to claim 3, further comprising:

an arm body;

said arm-body having a cross-section;

said cross-section includes three straight sides;

a connected portion of two sides of said cross-section; and said connected portion having an arc shape.

5. A bucket-type working machine according to claim 4, further comprising:

said arm body has a substantially triangular cross-section;

said arm body having a lower longitudinal surface;

said triangular cross-section having a lower surface thereof forming a triangular base side;

said triangular cross-section having an upper surface thereof forming a tip of said triangular cross-section;

a boom-mounting bracket; and said boom-mounting bracket is jointed to said lower longitudinal surface of said arm body.

6. A bucket-type working machine according to claim 5, further comprising:

a bucket cylinder bracket;

said arm body having an upper longitudinal surface;

said upper surface coincides with said upper longitudinal surface; and said bucket cylinder bracket is jointed to said upper surface of said arc connected portion of said two sides.

7. A bucket-type working machine according to claim 6, further comprising:

a bucket connection bracket;

an arm cylinder bracket;

said bucket connection bracket is jointed to an end of said arm body; and said arm cylinder bracket is jointed to another end of said arm body.

8. A bucket-type working machine according to claim 5, further comprising:

a bucket cylinder bracket;

said arm body having an upper longitudinal surface;

said upper surface having a flat portion at said tip;

said upper surface coincides with said upper longitudinal surface; and said bucket cylinder bracket is jointed to said flat portion of said tip.

9. A bucket-type working machine according to claim 8, further comprising:

a bucket connection bracket;

an arm cylinder bracket;

said bucket connection bracket is jointed to an end of said arm body; and said arm cylinder bracket is jointed to another end of said arm body.

10. A bucket-type working machine according to claim 3, wherein said bucket-type working machine is an excavator hydraulic shovel.

* * * * *